US005422706A

United States Patent [19]

Tsunemi et al.

[11] Patent Number: 5,422,706

[45] Date of Patent: Jun. 6, 1995

[54] PHOTOCONDUCTOR FOR XEROGRAPHY

[75] Inventors: Koichi Tsunemi, Kanagawa; Masahiro Hosoya, Saitama; Mitsunaga Saito, Tokyo; Hideyuki Nishizawa, Tokyo; Yoshimitsu Otaka, Shizuoka; Mitsuharu Endo, Shizuoka, all of Japan

[73] Assignees: Kabushiki Kaisha Toshiba, Kawasaki; Tokyo Electric Co., Ltd., Tokyo, both of Japan

[21] Appl. No.: 780,930

[22] Filed: Oct. 23, 1991

[30] Foreign Application Priority Data

| | | | |
|---|---|---|---|
| Oct. 23, 1990 | [JP] | Japan | 2-284581 |
| Nov. 21, 1990 | [JP] | Japan | 2-317054 |
| Mar. 26, 1991 | [JP] | Japan | 3-061941 |

[51] Int. Cl.[6] ..... G03G 5/00

[52] U.S. Cl. ..... 355/211

[58] Field of Search ..... 355/210, 211, 212, 208

[56] References Cited

U.S. PATENT DOCUMENTS

| | | | |
|---|---|---|---|
| 3,826,570 | 7/1974 | Kolibas | 355/213 |
| 4,157,260 | 6/1979 | Kimura et al. | 96/1.5 R |
| 4,258,113 | 3/1981 | Kuehnle | 430/94 |
| 4,292,386 | 9/1981 | Takano | 430/63 |
| 4,413,049 | 11/1983 | Beaudet et al. . | |
| 4,601,963 | 7/1986 | Takahashi et al. . | |
| 5,132,728 | 7/1992 | Suzaki et al. | 355/200 |
| 5,151,737 | 9/1992 | Johnson et al. | 355/211 |
| 5,229,813 | 7/1993 | Cherian | 355/200 |

FOREIGN PATENT DOCUMENTS

| | | |
|---|---|---|
| 2527797 | 12/1983 | France . |
| 57-139746 | 8/1982 | Japan . |

OTHER PUBLICATIONS

Patent Abstracts of Japan, vol. 8, No. 137 (P-282) (1574), Jun. 26, 1984, JP-A-59 37 582, Mar. 1, 1984.

Patent Abstracts of Japan, vol. 8, No. 97 (P-272) (1534), May 8, 1984, JP-A-59-10 980, Jan. 20, 1984.

*Primary Examiner*—Leo P. Picard

*Assistant Examiner*—Christopher Horgan

*Attorney, Agent, or Firm*—Oblon, Spivak, McClelland, Maier, & Neustadt

[57] ABSTRACT

A photoconductor is disclosed, which comprises a conductive cylindrical support which is substantially not hollowed, the conductive cylindrical support having a drive transferring mechanism coaxially and unifiedly provided on at least one of the end portions thereof, the conductive cylindrical support having a photoconductive layer on the outer periphery. The moment of inertia I (g . $cm^2$) of the substantially not-hollowed conductive support is in the range of $0.4 \leqq I \leqq 140$ (g . $cm_2$), the diameter thereof being in the range from 0.5 to 2.0 cm. When the relation of $C/(S \cdot \omega) \leqq 0.4$ (where S ($cm^2$) is the square measure of the portion of the photoconductive layer on the photoconductor; C (cal/°C.) is the heat capacity of the substantially not-hollowed cylindrical support; and ω (rad/s) is the rotating speed in development) is satisfied, high quality images can be readily and stably obtained without damages of the drive system.

18 Claims, 5 Drawing Sheets

(b) (a) (c)

PHOTOCONDUCTOR FOR XEROGRAPHY

BACKGROUND OF THE INVENTION

1. Field of the Invention

The present invention relates to a conductive cylindrical support for a photoconductor for laser printers, copying machines, facsimile machines, and so forth.

2. Description of the Related Art

The conventional photoconductive support for xerography is constructed on a cylindrical conductive support having flanges. The cylindrical conductive support (about 0.1 cm thickness) has a photoconductive layer formed on its outer periphery. A synthetic resin or a metal flange is crimped or adhered to both open end portions of the cylindrical conductive support.

For example, the conductive supports as shown in FIGS. 14 and 15 have been widely applied. The material of the photoconductive supports is a metal such as aluminum. The dimensions of the support are such that the outer diameter is around 6.0 cm; the length is around 24.0 cm; the thickness is around 0.1 cm; and the weight is around 120 g. The conductive support made of the cylindrical metal is comparatively light in weight because it is hollowed. Thus, such a conductive body helps to reduce the load applied to the drive system. However, it is difficult to accurately match the rotating axis of the cylindrical support with the rotating axis of the flange by a mechanical working or the like. Consequently, the photoconductive layer formed on the outer periphery of the support vibrates in the driving and the rotating process thereby adversely affecting each xerographic process. For example, since the gap between the surface of the photoconductor and the developer physically varies while the cylindrical support rotates unevenly developed images take place. In addition, since the length of the optical path varies, unsharp latent images take place and/or the resolution is decreased. Moreover, since the distance between the cylindrical support and the corona wire varies, uneven discharge takes place.

A producing method of substrate for excellent photoconductors is disclosed in Japanese Patent Tokkaisho No-57-139746. This invention particularly relates to a burnishing method of the surface of cylindrical photoconductors with a diameter of around 12 cm. However, this invention does not disclose conductive supports with a small outer diameter for providing photoconductors. In addition, this invention does not disclose a drive transferring mechanism which is coaxially unified with a photoconductive support.

To construct laser printers and copying machines in small sizes, the outer diameter of the cylindrical supports should be small. However, in this case, the moment of inertia of the cylindrical support remarkably is decreased. Thus, the support unevenly rotates and thereby uneven images take place in the vertical scanning direction of the laser printers and so forth.

To solve such a problem, if the moment of inertia of the cylindrical support is increased, the outer diameter and the weight thereof inevitably are increased. Thus, the drive system is excessively loaded and thereby remarkably shortens the service lives of the motors and gears used therein. In particular, when plastic gears, which are easily worked, are used, the service life thereof is further shortened.

SUMMARY OF THE INVENTION

An object of the present invention is to effectively prevent a photoconductor from rotating unevenly and to readily provide photoconductors with a high resolution in the vertical scanning direction along with stable high quality images.

Another object of the present invention is to provide an electrophotographic developing method for obtaining high quality images.

A photoconductor according to the present invention comprises a substantially non-hollow conductive cylindrical support which is provided with a drive transferring mechanism coaxially unified on at least one end portion thereof. In addition, a photoconductive layer is formed on the outer periphery of the conductive cylindrical support.

A further object of the present invention is to provide a coaxial conductive support. Thus, the substantial non-hollow conductive cylindrical support and the rotating axis are unified. Consequently, the photoconductor according to the present invention is free from unevenly developed images due to a variation of the gap between the support and the developer, decrease of the resolving power due to a variation of the optical path, uneven charging, and so forth. In addition, even if a through hole with a small diameter is provided at the center of a conductive cylindrical support, when it is coaxially unified with the rotating axis of the shaft, this conductive cylindrical support can be used.

The above mentioned photoconductor may be a shaft where the diameter of at least one of both the end portions of the conductive cylindrical support is smaller than the average diameter of the portion forming the photoconductive layer, this portion having a function for transferring motions from the main unit of the laser printer or the like. In addition, such a shaft can be provided on at least one of both the end portions of the conductive cylindrical support.

The moment of inertia I (g . cm$^2$) of this conductive cylindrical support is preferably set to the relation of $0.4 \leqq I \leqq 140$ (g . cm$^2$).

The reason why the moment of inertia I is selected and set in the above mentioned range is that when I exceeds 140, the drive system is excessively loaded and that when I is less than 0.4, uneven rotation of the support distinctly takes place.

In addition, according to the present invention, when the weight of a conductive cylindrical support is $W_1$ and the weight of a hollowed support constructed with the same material and with the same diameter and length as the conductive cylindrical support and with a thickness of 0.1 cm is $W_2$, $W_1$ and $W_2$ are preferably set to the range of $W_1/W_2 \leqq 7.8$ and more preferably set to the range of $W_1/W_2 \leqq 5.0$.

When $W_1$ and $W_2$ are set in the above mentioned ranges, the uneven rotation of the conductive cylindrical support can be effectively prevented or can be remarkably decreased. For example, uneven images in the vertical scanning direction of laser beam printers can be prevented and thereby high quality images can be obtained. In addition, since an excessive load applied to the drive system can be reduced, the decrease of the service life thereof can be prevented. In other words, a further object of the present invention is to prevent the service life of the drive system and the photoconductor from shortening.

Moreover, in an electrophotographic developing method according to the present invention, images are developed so that the following relation is set $$C/(S \cdot \omega) \leqq 0.4$$

where S ($cm^2$) is the square measure of the portion of a photoconductive layer formed on the outer periphery of a conductive support; C (cal/°C.) is the heat capacity of the cylindrical support; and $\omega$ (rad/s) is the rotating speed at which electrostatic latent images formed on the photoconductive layer are developed by using a toner. When the above mentioned relation is satisfied, heat does not stay inside a machine such as a laser printer. Thus, even if a semiconductor laser with an oscillation property which is remarkably affected by the temperature is used, an abnormality of oscillation stop does not take place. Thus, the electro-photographic developing method according to the present invention usually provides high quality images.

Furthermore, in another electrophotographic developing method according to the present invention, images are developed so that the following relation is set.

$$r \cdot p \leqq 2.3$$

where r (cm) is the radius of curvature of a substantially not-hollowed conductive cylindrical support and is 0.75 cm or less; and p (cm/s) is the peripheral speed of the photoconductor at which electrostatic latent images formed on the photoconductive layer are developed by using a toner, namely, the speed of the surface of the photoconductor on the outer periphery. When the above mentioned relation is satisfied, the resolving power in the vertical scanning direction in exposing images can be remarkably improved.

In other words, as the radius of curvature of the conductive cylindrical support decreases, when images are exposed, they are compressed in the vertical scanning direction and thereby the resolution thereof in this direction improves. The improvement of the resolution depends on the radius of curvature r. The improvement of resolution is reversely proportional to the radius of curvature r. However, when the radius of curvature r is less than a particular value, if the rotating speed of the photoconductor becomes large, the resolution adversely decreases. Thus, when the radius of curvature r and the peripheral speed p of the photoconductor are set so that the above mentioned relation is satisfied, the resolution in the vertical scanning direction can be effectively improved.

DESCRIPTION OF PREFERRED EMBODIMENTS

Figure 1:
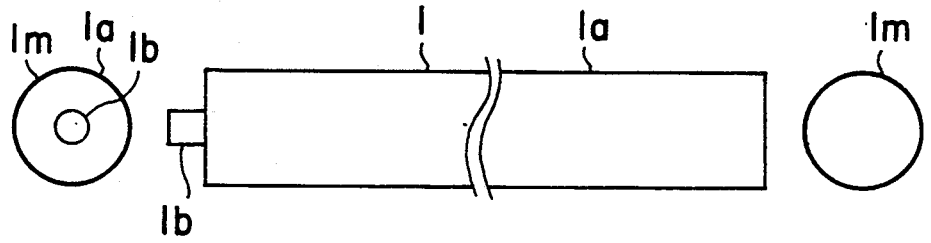
FIGS. 1(*a*) to 13(*c*) are constructional examples of conductive cylindrical supports comprising a principal portion of photoconductors according to the present invention, wherein letter (a) represents a plan view and letters (b) and (c) represent side views.

Now, embodiments according to the present invention will be described. First, the general constructions of photoconductors according to the present invention are described.

A photoconductor according to the present invention is constructed for example so that the diameter of at least one of both the end portions of a conductive cylindrical support where the photoconductive layer is not formed is smaller than that of a portion where the photoconductive layer is formed. In this case, although the length of the small diameter portion depends on the overall length of the conductive cylindrical support and the diameter of the center portion thereof, it is generally in the range from 0.05 to 2.5 cm and preferably in the range from 0.5 to 1.5 cm. In addition, although the diameter of the end portions depends on the overall length of the conductive cylindrical support, the diameter of the center portion thereof, and so forth, it is preferable to satisfy the following relation.

$$0.01 \leqq D - d \leqq 2.0$$

where D (cm) is the diameter of the center portion of the conductive cylindrical support where the photoconductive layer is formed on the outer periphery thereof; and d (cm) is the diameter of the end portions where the photoconductive layer is not formed on the outer periphery thereof.

However, when D is 3.0 cm or more, the material of the conductive cylindrical support is aluminum, and the overall length thereof is 24.0 cm, then the weight of the conductive cylindrical support is 400 g or more and thereby excessively loading the drive system. Thus, D is set to 2.0 cm or less and preferably set to 1.5 cm or less. In contrast, when D is less than 0.5 cm, uneven rotation may adversely take place in driving the conductive cylindrical support. Thus, D is preferably set to 0.5 cm or more.

When the dimensional allowance of the length and diameter of the photoconductive layer and the length and the diameter of the end portions of the conductive cylindrical support according to the present invention is ±10% or less of the desired dimensions, the required operation and effect can be obtained.

The diameter of the photoconductive layer formed area of the support is generally and substantially the same regardless of its center portion and its end portions. However, the conductive cylindrical support may be constructed in a barrel shape or in a bobbin shape so as to contact it with a cleaning blade, developer, and so forth. The barrel shape is a shape where the diameter of the center portion is larger than that of the end portions. The bobbin shape is a shape where the diameter of the center portion is smaller than that of the end portions. In these cases, the difference between the diameter of the center portion and that of the end portions is at most around 20%.

On the other hand, parts such as a gear, a pulley, a timing pulley for a timing belt, and so forth for driving the photoconductor can be disposed on the end portions which have a small diameter and where the photoconductive layer is not formed on the outer periphery thereof. In addition, it is possible to provide a groove and a projection for preventing the photoconductor from dropping. When such a groove and/or a projection is disposed, the photoconductor itself can be worked or they can be provided with other parts by a fixing method such as cramping or adhering. In particular, when the conductive cylindrical support is worked and unified with a motion transferring mechanism such as a gear, the required number of parts can be reduced thereby contributing to lowering the cost. In addition, such a worked portion can be used as a drop stopping portion or an E ring guide for connecting the photoconductor to another portion.

The small diameter portion is not limited to a single stage. Where necessary, the small diameter portions can be disposed for a plurality of stages.

In addition, the drop stopping portions can be provided by using a though hole or non-through hole as well as a groove and a projection. Moreover, it is possible to provide a plurality of grooves and projections on each end portion.

The end portion with the small diameter of the conductive cylindrical support can have for example a taper for preventing it from vibrating in the direction of the longitudinal axis.

In the above description, the end portions with the small diameter of the conductive cylindrical support were shafts with a function for transferring the motions from the main unit. However, the present invention is not limited to such shafts. Rather, it is possible to form a photoconductive layer on the outer periphery except for the vicinity of the end portions of a conductive cylindrical support with a particular diameter and to use the vicinity of the end portions, where the photoconductive layer is not formed, as a shaft.

To set the moment of inertia of the conductive cylindrical support, it is possible to consider only the center portion with the large diameter thereof where the photoconductive layer is formed. In other words, although the diameter of both the end portions may be smaller than that of the center portion, since the weight and the diameter of the worked portions on both the ends are small, their moment of inertia is small and negligible. Likewise, since the thickness of the photoconductive layer formed on the surface of the conductive cylindrical support is at most around 200 μm, its contribution to the moment of inertia can be neglected.

When the moment of inertia I (g . cm$^2$) is set to the range of $0.4 \leqq I \leqq 140$, the desired operation and effect can be obtained. The moment of inertia I (g . cm$^2$) of a not-hollowed cylindrical support can be readily calculated with the following equation.

$$I = MR^2/2$$

where R (cm) is the radius of the not-hollowed cylindrical support; and M (g) is the mass thereof.

Materials of the conductive cylindrical supports used in the present invention are metal such as brass, stainless steel, aluminum, iron, copper, and so forth; plated materials thereof; conductive resins such as phenol resin with conductivity; glass with conductivity; amorphous carbon, and so forth.

The end portions of such conductive cylindrical supports can be worked by any available method such as casting, lathe working, compression, extrusion, injection, and so forth.

Since the worked conductive cylindrical supports always have edge portions, these portions are preferably chamfered or rounded. In addition, when a conductive cylindrical support is plated with a metal, since the thickness of the metal plate is very thin in comparison with the conductive cylindrical support, it hardly affects the diameter, weight, and so forth of the conductive cylindrical support. Moreover, it is possible to make a hole for positioning at the center of at least one of both the end portions.

For the photoconductors according to the present invention, any charge generating material which absorbs rays and generates charges with a high efficiency can be used. Examples of inorganic charge generating materials are selenium, selenium alloys; CdS, CdSe, AsSe, ZnO, amorphous silicon and so on. Examples of organic ones are metal phthalocyanine such as copper phthalocyanine, metal oxide phthalocyanine such as vanadyl phthalocyanine and titanial phthalocyanine; metal chloride phthalocyanine, indium chloro-phthalocyanine and aluminum chloro-phthalocyanine; metal chalcogenide phthalocyanine and metal-free phthalocyanine; azo type pigments such as mono-azo, dis-azo, tris-azo, and tetra-azo type pigment; condensed ring quinone derivative pigments such as perylene type pigments, indigoid derivative pigments, quinacridone type pigments, anthraquinone and antho anron pigment; charge transfer complex comprising cyanine, an electron accepting material and an electron donating material; eutectic complex comprising pyrylium salt pigment and polycarbonate resin; and azulenium salt.

With respect to the photoconductors according to the present invention, a photoconductive layer formed on the outer periphery of an conductive cylindrical support may be a mono layer type, which has both functions for charge generation and transport, or a multilayer type, which has two layers with respective functions for doing so.

Photoconductors are conventionally categorized as positive charging type and negative charging type depending on charging polarity. However, the photoconductors according to the present invention are not limited to these types.

In the case of the multilayer type photoconductor, although the forming method of the charge generating layer depends on the type of the electric charge generating material to use, one of various coating methods such as spin coating method, dipping coating method, roller coating method, spray coating method, vacuum deposition method, spattering method, and plasma CVD method using glow discharging can be selected and used.

On the other hand, in the case of the mono layer type photoconductor, the above mentioned methods can be selected and used so as to form the photoconductive layer.

In the case of the mono layer type photoconductor, although the thickness of the photoconductive layer to form depends on what type of the photoconductor to use, it is normally in the range from 10 to 200 μm.

In the case of the multilayer type photoconductor, although the thickness of the charge generating layer to form depends on the electrostatic characteristics necessary for the photoconductor, it is preferably in the range from 0.1 to 5 μm. In the case of the multilayer type photoconductor, a charge transport layer is required as well as the charge generating layer. The charge transport layer is conventionally formed in the following manner. A predetermined amount of a material with a charge transport capability is dissolved equally with an organic solvent along with a suitable polymer. Thereafter, the resultant solution is coated by using the dip-coating and then dried so as to form a thin film with a thickness preferably in the range from 15 to 25 μm. When a polymer with the charge transport capability is selected, the amount of the electric charge transmitting material to add can be decreased. Depending on the situation, it is not necessary to add the electric charge transmitting material at all. In addition, when the material with the electric charge transmitting capability has enough film forming property, it is possible to minimize the amount of the polymer to mix.

Depending on the polarity of the electric charges applied to the photoconductor, the electric charge generating layer and the electric charge transmitting layer are multilayered in sequence or vice versa on the cylindrical support. However, the multilayering sequence of these layers according to the present invention is not limited to these sequences.

In the present invention, regardless of the mono layer type and the multilayer type to use, where necessary, at least one of an intermediate layer and a protective layer can be formed. Examples of the materials of the intermediate layer are casein, polyamide, polyvinyl alcohol, gelatin, cellulose, and derivatives thereof. The thickness of the intermediate layer is normally in the range from 0.1 to 10 μm and preferably in the range from 0.2 to 2 μm. Examples of materials used for the protective layer are thermoplastic resins such as acrylic resin, fluororesin, and silicone resin; thermosetting resins such as phenol resin and melamine resin; light-setting resins; EB-setting resins; X-ray-setting resins; and UV-setting resins. In addition, a small amount of additive such as oxidation inhibitor, ultraviolet absorbent, and antioxidant can be added to at least one of layers which construct the photoconductive layer.

When a photoconductive layer is formed on the outer periphery of a conductive cylindrical support by using the dipping coating method, the photoconductive layer may adhere to the end portions where the photoconductor should not be formed. The adhered photoconductive layer can be removed with a solvent which can dissolve it or by dipping it therein.

The conductive cylindrical support according to the present invention is substantially not hollowed, a rotating shaft which is smaller than the portion where the photoconductive layer is formed can be unifiedly worked or formed at both the end portions thereof. When a photoconductive layer is formed on such a support by using the dipping coating method, the photoconductive layer adheres to the end portions where the photoconductive layer should not be formed. In this case, prepare sponge, foaming polyethylene, or foaming polyurethane which matches the shape of the end portions and soak it in a solvent which can dissolve the adhered photoconductive layer. Thereafter, rotate the conductive cylindrical support with such a material held on the end portions thereof so as to remove the adhered photoconductive layer. As an alternative method, dip the conductive cylindrical support in the above mentioned solvent and then vertically move and rotate it so as to dissolve the adhered photoconductive layer. In addition, when vertical moving and rotating the conductive cylindrical support, it is possible to put the end portions of the cylindrical support in and out of the solvent tank. In this case, when a plurality of solvent tanks rather than a single solvent tank are provided, a good effect can be obtained. In addition, when ultrasonic cleaning is performed by applying an ultrasonic wave to the solvent tanks, a good result can be obtained.

When at least one of the end portions of the conductive cylindrical support is cut in a D letter shape, the motions from the main unit can be readily and securely transferred. In addition, in this construction, the surface vibration in the radius direction of the photoconductor can be suppressed.

Now, embodiments according to the present inventions will be described. However, it should be understood that the present invention is not limited to the embodiments that follow.

Embodiment 1

Figure 2:
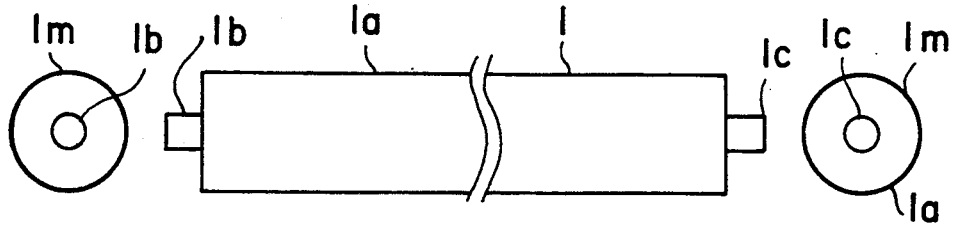

First, an aluminum conductive cylindrical support was prepared in the construction as shown in FIG. 2(*a*) (a plan view) and in FIG. 2(*b*) and (*c*) (side views). The length and the diameter of the conductive cylindrical support 1 were 24.0 cm and 1.5 cm, respectively. The diameter of both the end portions of the conductive cylindrical support 1 was smaller than that of the center portion thereof. The length and the diameter of the extruded small diameter areas 1*b* and 1*c* were 1.0 cm and 1.0 cm, respectively. These areas 1*b* and 1*c* were coaxial to the center portion.

The moment of inertia of the conductive cylindrical support 1 was 32.2 g . $cm^2$.

Thereafter, the conductive cylindrical support was dipped in a solution where alcohol-soluble polyamide (K-80 from Toray K.K.) was dissolved in methanol to coat the resultant solution on the periphery of the photoconductive layer forming area. Thereafter, the conductive cylindrical support was dried to form a polyamide coated layer with a film thickness of 0.6 μm.

Thereafter, τ type metal-free phthalocyanine (Toyo Ink K.K.) and polyvinyl butyral (SLEC BM-1, from Sekisui Kagaku K.K.) were mixed in the same ratio of 1 to 1 by weight in cyclohexanone and dispersed then dipped and dried with a coating solution which was mixed for 24 hours by using a ball mill. A charge generating layer with a film thickness of 0.2 μm was formed on the polyamide coated layer of the conductive cylindrical support.

Thereafter, N-ethylcarbazole-3-carboxy aldehydemethyl phenylhydrazone, which is one of hydrazone derivatives, and polycarbonate (from K-1300W, Teijin Kasei K.K.) were prepared in the ratio of 1 to 1 by weight. These were dissolved in 1,1,2-trichloroethane to obtain homogeneous solution. In the resultant homogeneous solution, the conductive cylindrical support on which the above mentioned charge generating layer was formed was dipped and dried. Thereby, a charge transmitting layer with a film thickness of 20.0 μm was formed on the charge generating layer. When each layer was formed by the above mentioned dipping and drying processes, polyamide layer adhering at both the end portions was removed with methanol; and the electric charge generating layer and the charge transport layer were removed with dichloromethane. Thereby, a photoconductive layer with a length of 23.0 cm was formed on the outer periphery of the conductive cylindrical support.

A photoconductor having a photoconductive layer 1*m* in three layered construction was mounted in an electrophotographic laser printer and then unevenness in the vertical scanning direction was measured. The unevenness in the vertical scanning direction was determined by drawing a pattern with three sets of lines and spaces per 1 mm and calculating the standard deviation of the distance between lines. As the standard deviation is small, the unevenness in the vertical scanning direction is small. Table 1 shows these measurement results.

On the other hand, the printer was operated at the process speed equivalent to the printing of A4 sheets of A4 size per minute at a room temperature of 35° C. so as to test whether or not an abnormality of the drive system (motors and gears) takes place. The abnormality of the drive system was measured by counting a time until the drive system became abnormal in cycles of one-minute printer operation and 5-second printer stop. When no abnormality took place even if the time exceeded 36 hours, it was determined that the test result was OK. Table 1 also shows the results of this test.

Embodiments 2 to 12, Comparisons 1 to 4

Photoconductors were constructed in the same conditions as those in Embodiment 1 except that the length, the diameter, and the moment of inertia of the photoconductive layer formed area of the aluminum non-hollowed conductive cylindrical supports of the former were different from those in Embodiment 1. In addition, photoconductors were constructed in the same conditions as those in Embodiment 1 except that the materials of the not-hollowed conductive cylindrical supports was nickel plated cast iron and stainless steel (SUS304) and that the length, the diameter, and the moment of inertia of the photoconductive layer formed area were different from those in Embodiment 1. Table 1 shows the results of the evaluations of these photoconductors as Embodiments 2 to 12.

In addition, for comparisons, photoconductors were constructed in the same conditions as those in Embodiment 1 except that substantially non-hollowed conductive cylindrical supports with a diameter of 2.0 cm and made of nickel plated cast iron and stainless steel (SUS304) (Comparisons 1 and 2) and hollowed aluminum conductive cylindrical supports with a thickness of 0.1 cm (Comparisons 3 and 4) were used. Table 1 shows the results of the evaluations of these conductive cylindrical supports as Comparisons 1 to 4. In Table 1, material A, material B, and material C represent aluminum, nickel plated cast iron, and stainless steel (SUS304), respectively.

In Embodiment 1, the weight $W_1$ of the aluminum not-hollowed conductive cylindrical support was 114.5 g. On the other hand, in Comparison 3, the material and shape of the conductive cylindrical support were the same as those in Embodiment 1 except that the conductive cylindrical support was hollowed and the thickness thereof was 0.1 cm. The weight $W_2$ of the conductive cylindrical support in Comparison 3 was 28.5 g. In addition, there was a relation of $W_1/W_2=4.0$. Moreover, with respect to the photoconductors in Embodiments 2 to 12, $W_1$ and $W_2$ were set so that the relation of $W_1/W_2 \leqq 7.8$ was satisfied. As shown in Table 1, the photoconductors used in these embodiments according to the present invention provided good images without any abnormality of the drive system.

On the other hand, although the conductive cylindrical supports used in Comparisons 1 and 2 were substantially not hollowed, the moment of inertia I was 296.3, which is out of the range of $0.4 \leqq I \leqq 140$. Thus, as shown in Table 1, with respect to Comparisons 1 and 2, abnormalities took place in a short time in the drive system.

Embodiment 13

First, an aluminum conductive cylindrical support in the construction as shown by a plan view of FIG. 1(*a*) and by side views of FIG. 1(*b*) and (*c*) was prepared. The length and the diameter of a photoconductive layer formed area 1*a* of the conductive cylindrical support 1 were 24.0 cm and 3.0 cm, respectively. The diameter of one end portion of the conductive cylindrical support 1 was smaller than that of the center portion thereof. The length and the diameter of one extruded small diameter area 1*b* were 1.0 cm and 1.0 cm, respectively. The area 1*b* was coaxial to the center portion.

Thereafter, the conductive cylindrical support 1 was dipped in a solution where alcohol-soluble polyamide (K-80, from Toray K.K.) was dissolved in methanol to coat the resultant solution on the periphery of the photoconductive layer forming area 1*a*. Thereafter, the conductive cylindrical support was dried so as to form a polyamide coated layer with a film thickness of 0.6 μm.

Thereafter, τ type metal-free phthalocyanine (Toyo Ink K.K.) and polyvinyl butyral (SLEC BM-1 from Sekisui Kagaku K.K.) were mixed in the same ratio of 1 to 1 by weight in cyclohexanone and dispersed then dipped and dried with a coating solution which was mixed for 24 hours by using a ball mill. A charge generating layer with a film thickness of 0.2 μm was formed on the polyamide coated layer of the conductive cylindrical support.

Thereafter, N-ethylcarbazole-3-carboxy aldehyde-methyl phenylhydrazone, which is one of hydrazone derivatives, and polycarbonate (K-1300W from Teijin Kasei K.K.) in the ratio of 1 to 1 by weight. These were dissolved in 1,1,2-trichloroethane to obtain homogeneous solution. In the resultant homogeneous solution, the conductive cylindrical support on which the above mentioned electric charge generating layer was formed was dipped and dried. Thereby, an electric charge transmitting layer with a film thickness of 20.0 μm was formed on the electric charge generating layer. When each layer was formed by the above mentioned dipping and drying processes, polyamide layer adhering at the end portion (right end of FIG. 1(*a*)) was removed with methanol; and the electric charge generating layer and the electric charge transmitting layer were removed with dichloromethane.

The coaxial property of the photoconductor having the photoconductive layer 1*m* in three layered construction was measured in accordance with the method defined in JIS B-0621. The resultant coaxial property was 30.3 μm. In addition, when the photoconductor was mounted in an electro-photographic apparatus and then a developing evaluation was performed, no rotating deviation took place. Thus, images could be developed without uneven development, decrease of resolving power, and uneven discharging.

In addition, when a photoconductor was used in the same construction as Embodiment 13 except that a V letter shaped concaved portion with a diameter of 0.4 cm and with a depth of 0.2 cm, the same results as Embodiment 13 was obtained.

Embodiment 14

First, an aluminum conductive cylindrical support in the construction as shown by a plan view of FIG. 2(*a*) and by side views of FIG. 2(*b*) and (*c*) was prepared. The length and the diameter of a photoconductive layer formed area 1*a* of the conductive cylindrical support 1 were 24.0 cm and 3.0 cm, respectively. The diameter of both the end portions of the conductive cylindrical support 1 was smaller than that of the center portion thereof. The length and the diameter of extruded small diameter areas 1*b* and 1*c* were 1.0 cm and 1.0 cm, respectively. The areas 1*b* and 1*c* were coaxial to the center portion.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 31.0 μm. In addition, the results of the developing evaluation were similar to those in Embodiment 13.

Embodiment 15

Figure 3:
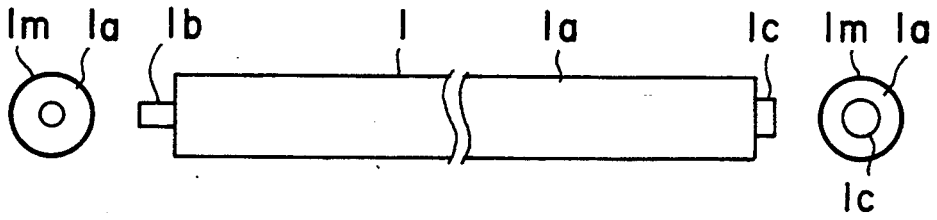

First, an aluminum conductive cylindrical support in the construction as shown by a plan view of FIG. 3(*a*) and by side views of FIG. 3(*b*) and (*c*) was prepared. The length and the diameter of a photoconductive layer formed area 1*a* of the conductive cylindrical support 1 were 24.0 cm and 2.0 cm, respectively. The diameter of both the end portions of the conductive cylindrical support 1 was smaller than that of the center portion thereof. The length and the diameter of one extruded small diameter area 1*b* were 1.0 cm and 0.6 cm, respectively. The length and the diameter of the other extruded small diameter area 1*c* were 0.5 cm and 1.0 cm, respectively. The areas 1*b* and 1*c* were coaxial to the center portion.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 26.8 μm. In addition, the results of the developing evaluation were similar to those in Embodiment 13.

Embodiment 16

Figure 4:
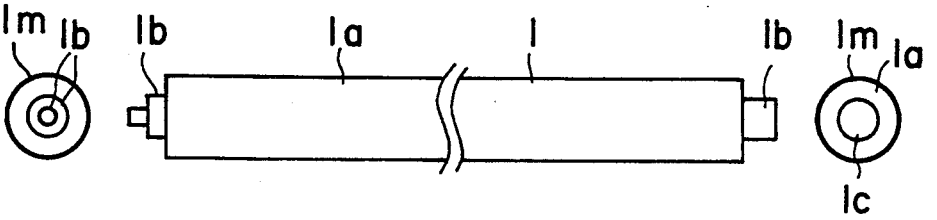

First, an aluminum conductive cylindrical support in the construction as shown by a plan view of FIG. 4(*a*) and by side views of FIG. 4(*b*) and (*c*) was prepared. The length and the diameter of a photoconductive layer formed area 1*a* of the conductive cylindrical support 1 were 24.0 cm and 2.0 cm, respectively. The diameter of both the end portions of the conductive cylindrical support 1 was smaller than that of the center portion thereof. One extruded small diameter area 1*b* has a shoulder. The length and the diameter of the area 1*b* were 0.5 cm and 1.0 cm, respectively. The length and the diameter of the shoulder of area 1*b* were 0.5 cm and 0.4 cm, respectively. The length and the diameter of the other extruded small diameter area 1*c* were 1.0 cm and 1.0 cm, respectively. The areas 1*b* and 1*c* were coaxial to the center portion.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 29.4 μm. In addition, the results of the developing evaluation were similar to those in Embodiment 13.

Embodiment 17

Figure 5:
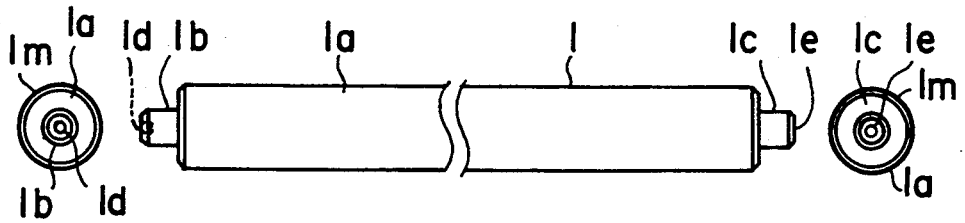

First, an aluminum conductive cylindrical support in the construction as shown by a plan view of FIG. 5(*a*) and by side views of FIG. 5(*b*) and (*c*) was prepared. The length and the diameter of a photoconductive layer formed area 1*a* of the conductive cylindrical support 1 were 24.0 cm and 2.0 cm, respectively. The diameter of both the end portions of the conductive cylindrical support 1 was smaller than that of the center portion thereof, both the end portions being coaxial to the center portion. The edge portions of the photoconductive layer formed area 1*a* were tapered. The length and the diameter of the area 1*b* were 1.0 cm and 1.0 cm, respectively. The edge portion of the area 1*b* was tapered. A concaved portion 1*d* was disposed at the center of the area 1*b*. The diameter and the depth of the concaved portion 1*d* were 0.4 cm and 0.2 cm, respectively. The length and the diameter of the area 1*c* were 1.0 cm and 1.0 cm, respectively. The edge portion of the area 1*c* was tapered. A V letter shaped concaved portion 1*e* was disposed at the center of the area 1*c*. The diameter and the depth of the concaved portion 1*e* were 0.4 cm and 0.2 cm, respectively.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 25.5 μm. In addition, the results of the developing evaluation were similar to those in Embodiment 13.

Embodiment 18

Figure 6:
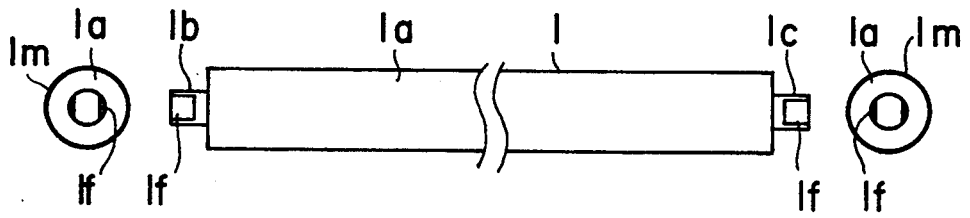

First, an aluminum conductive cylindrical support in the construction as shown by a plan view of FIG. 6(*a*) and by side views of FIG. 6(*b*) and (*c*) was prepared. The length and the diameter of a photoconductive layer formed area 1*a* of the conductive cylindrical support 1 were 24.0 cm and 2.0 cm, respectively. The diameter of both the end portions of the conductive cylindrical support 1 was smaller than that of the center portion thereof, both the end portions being coaxial to the center portion. The length and the diameter of one extruded small diameter area 1*b* were 1.0 cm and 1.0 cm, respectively. The area 1*b* had opposed flat surfaces 1*f*. The length from the end portion and the depth of the flat surfaces were 0.7 cm and 0.1 cm, respectively. The length and the diameter of the other extruded small diameter area 1*c* were 1.0 cm and 1.0 cm, respectively. The area 1*c* had opposed flat surfaces 1*f*. The length from the end portion and the depth of the flat surfaces were 0.7 cm and 0.1 cm, respectively.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 28.8 μm. In addition, the results of the developing evaluation were similar to those in Embodiment 13.

Embodiment 19

Figure 7:
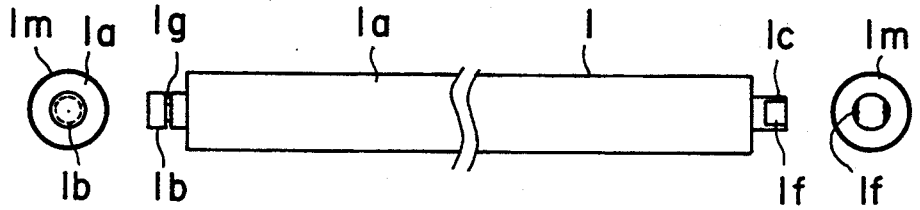

First, an aluminum conductive cylindrical support in the construction as shown by a plan view of FIG. 7(*a*) and by side views of FIG. 7(*b*) and (*c*) was prepared. The length and the diameter of a photoconductive layer formed area 1*a* of the conductive cylindrical support 1 were 24.0 cm and 1.0 cm, respectively. The diameter of both the end portions of the conductive cylindrical support 1 was smaller than that of the center portion thereof, both the end portions being coaxial to the center portion. The length and the diameter of one extruded small diameter area 1b were 0.5 cm and 0.4 cm, respectively. The area 1b had a groove 1g on the periphery around 0.25 cm apart from the end portion. The width and the depth of the groove 1g were 0.05 cm and 0.05 cm, respectively. The length and the diameter of the other extruded small diameter area 1c were 0.5 cm and 0.4 cm, respectively. The area 1c had opposed flat surfaces 1f. The length from the end portion and the depth of the flat surfaces 1f were 0.35 cm and 0.05 cm, respectively.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 31.2 μm. In addition, the results of the developing evaluation were similar to those in Embodiment 13.

Embodiment 20

Figure 8:
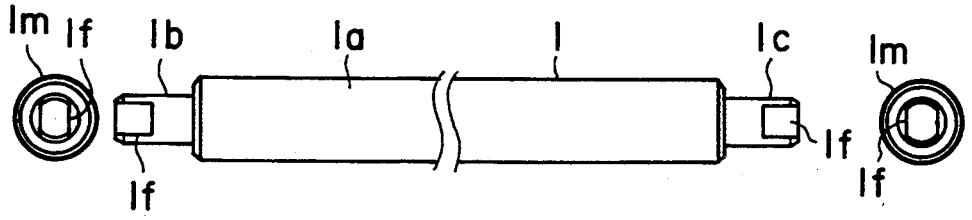

First, an aluminum conductive cylindrical support in the construction as shown by a plan view of FIG. 8(*a*) and by side views of FIG. 8(*b*) and (*c*) was prepared. The length and the diameter of a photoconductive layer formed area 1a of the conductive cylindrical support 1 were 24.0 cm and 1.0 cm, respectively. The diameter of both the end portions of the conductive cylindrical support 1 was smaller than that of the center portion thereof, both the end portions being coaxial to the center portion. The edge portions of the photoconductive layer formed area 1a were tapered. The length and the diameter of extruded small diameter areas 1b and 1c were 1.0 cm and 0.6 cm, respectively. The edge portions of the areas 1b and 1c were tapered. The areas 1b and 1c had opposed flat surfaces if on the outer periphery. The length from the end portion and the depth of the flat portions 1f were 0.5 cm and 0.1 cm, respectively.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 29.6 μm. In addition, the results of the developing evaluation were similar to those in Embodiment 13.

Embodiment 21

Figure 9:
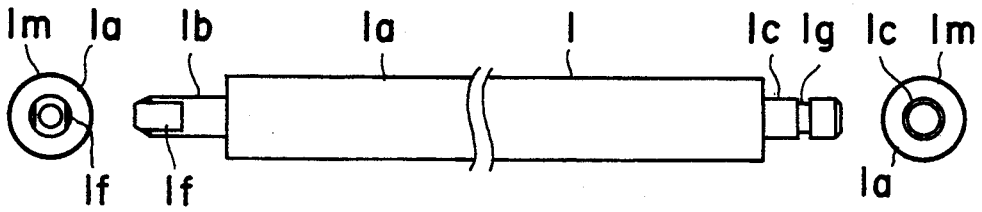

First, an aluminum conductive cylindrical support in the construction as shown by a plan view of FIG. 9(*a*) and by side views of FIG. 9(*b*) and (*c*) was prepared. The length and the diameter of a photoconductive layer formed area 1a of the conductive cylindrical support 1 were 24.0 cm and 1.0 cm, respectively. The diameter of both the end portions of the conductive cylindrical support 1 was smaller than that of the center portion thereof, both the end portions being coaxial to the center portion. The length and the diameter of one extruded small diameter area 1b were 2.5 cm and 0.5 cm, respectively. The edge portion of the area 1b was tapered. The area 1b had opposed flat surfaces 1f on the outer periphery. The length from the end portion and the depth of the flat portions 1f were 1.0 cm and 0.1 cm, respectively. The length and the diameter of the other extruded small diameter area 1c were 1.0 cm and 0.5 cm, respectively. The edge portion of the area 1c was tapered. The area 1c had a groove 1g at the outer periphery. The width and the depth of the groove 1g were 0.1 cm and 0.1 cm, respectively.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 31.4 μm. In addition, the results of the developing evaluation were similar to those in Embodiment 13.

Embodiment 22

Figure 10:
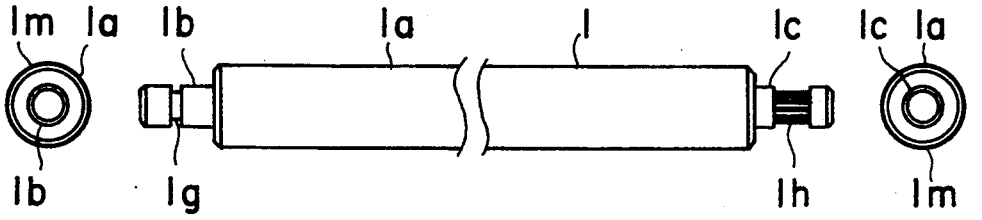

First, an aluminum conductive cylindrical support in the construction as shown by a plan view of FIG. 10(*a*) and by side views of FIG. 10(*b*) and (*c*) was prepared. The length and the diameter of a photoconductive layer formed area 1a of the conductive cylindrical support 1 were 24.0 cm and 1.0 cm, respectively. The diameter of both the end portions of the conductive cylindrical support 1 was smaller than that of the center portion thereof, both the end portions being coaxial to the center portion. Both the edge portions of the photoconductive layer formed area 1a were tapered. The length and the diameter of one extruded small diameter area 1b were 1.15 cm and 0.5 cm, respectively. The edge portion of the area 1b was tapered. The area 1b had a groove 1g on the center periphery. The width and the depth of the groove 1g were 0.1 cm and 0.1 cm, respectively. The length and the diameter of the other extruded small diameter area 1c were 1.0 cm and 0.5 cm, respectively. The edge portion of the area 1c was tapered. The area 1c had a gear 1h on the center periphery.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 30.0 μm. In addition, the results of the developing evaluation were similar to those in Embodiment 13.

Embodiment 23

Figure 11:
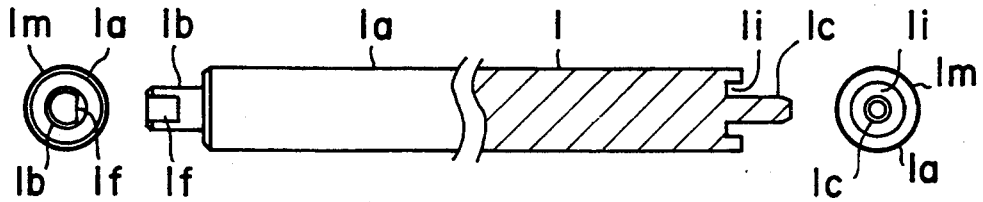

First, an aluminum conductive cylindrical support in the construction as shown by a plan view of FIG. 11(*a*) and by side views of FIG. 11(*b*) and (*c*) was prepared. The length and the diameter of a photoconductive layer formed area 1a of the conductive cylindrical support 1 were 24.0 cm and 1.0 cm, respectively. The diameter of both the end portions of the conductive cylindrical support 1 was smaller than that of the center portion thereof, both the end portions being coaxial to the center portion. Both the edge portions of the photoconductive layer formed area 1a were tapered. The length and the diameter of one extruded small diameter area 1b were 0.8 cm and 0.5 cm, respectively. The edge portion of the area 1b was tapered. The length and the diameter of the other extruded small diameter area 1c were 0.9 cm and 0.3 cm, respectively. The edge portion of the area 1c was tapered. The photoconductive layer formed area 1a had a concaved portion 1i on the end portion.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 29.9 μm. In addition, the results of the developing evaluation were similar to those in Embodiment 13.

Embodiment 24

Figure 12:
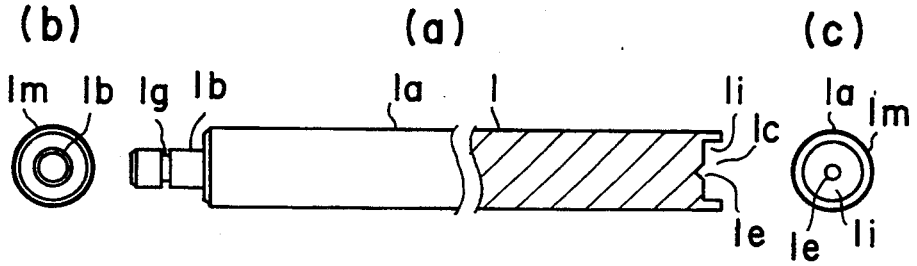

First, an aluminum conductive cylindrical support in the construction as shown by a plan view of FIG. 12(*a*) and by side views of FIG. 12(*b*) and (*c*) was prepared. The length and the diameter of a photoconductive layer formed area 1*a* of the conductive cylindrical support 1 were 23.7 cm and 1.0 cm, respectively. The diameter of one end portion of the conductive cylindrical support 1 was smaller than that of the center portion thereof, the end portion being coaxial to the center portion. The edge portion of the photoconductive layer formed area 1*a* was tapered. The length and the diameter of an extruded small diameter area 1*b* were 1.1 cm and 0.5 cm, respectively. The edge portion of the area 1*b* was tapered. The area 1*b* had a groove 1*g* at the center portion. The width and the depth of the groove 1*g* were 0.1 cm and 0.1 cm, respectively.

The other edge portion 1*c* had coaxially a V letter shaped concaved portion 1*e*. The depth and the diameter of the portion 1*e* were 0.3 cm and 0.8 cm, respectively.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 30.8 μm. In addition, the results of the developing evaluation were similar to those in Embodiment 13.

Embodiment 25

Figure 13:
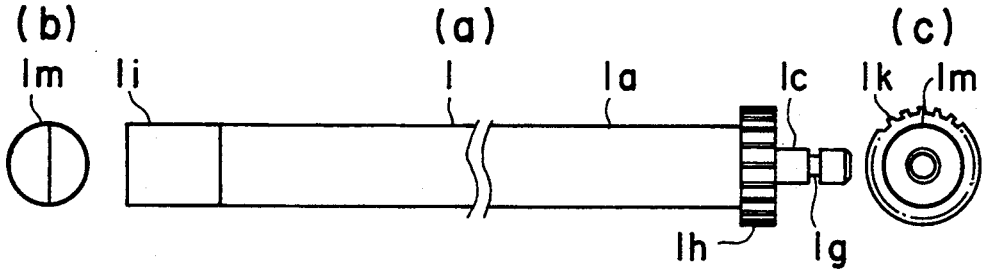

First, an aluminum conductive cylindrical support in the construction as shown by a plan view of FIG. 13(*a*) and by side views of FIG. 13(*b*) and (*c*) was prepared. The length and the diameter of a photoconductive layer formed area 1*a* of the conductive cylindrical support 1 were 24.0 cm and 1.0 cm, respectively. The length of one end portion of the conductive cylindrical support 1 was 1.25 cm and a D letter shaped portion 1*j* is disposed on this side. The diameter of the other end portion of the conductive cylindrical support 1 was smaller than that of the center portion thereof, the end portion being coaxial to the center portion. The edge portion of the area 1*c* was tapered. The area 1*c* had a groove on the center periphery. The width and the depth of the groove were 0.1 cm and 0.1 cm, respectively. The area 1*c* also had a drive gear 1*h* with a diameter of 1.5 cm.

A photoconductor was produced in the same manner as Embodiment 13 except that the conductive cylindrical support in the above mentioned construction was used. In the same manner as Embodiment 13, the coaxial property of the photoconductor was measured and then the developing evaluation was performed. As the result, the coaxial property was 30.5 μm. In addition, the results of the developing evaluation were similar to those in Embodiment 13.

Comparisons 5 and 6

Figure 14:
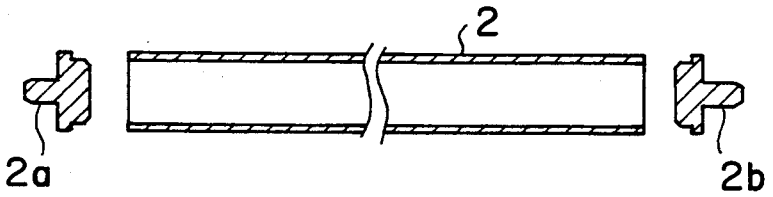
FIGS. 14 and 15 are exploded sectional views showing constructional examples of conductive cylindrical supports comprising a principal portion of conventional photoconductors.
Figure 15:
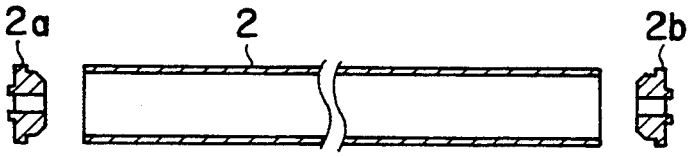

Aluminum drums 2 with a thickness of 0.1 cm were prepared as shown by sectional views of FIGS. 14 and 15. The diameter and the length of the aluminum drums 2 were 2.0 cm and 24.0 cm, respectively. Flanges as shown in the figures were cramped or fastened so as to construct conductive supports.

Photoconductors were produced in the same manner as Embodiment 13 except that the above mentioned conductive cylindrical supports (aluminum drums 2) were used. In the same manner as Embodiment 13, the coaxial property was measured and the developing evaluation was performed. The coaxial property in Comparison 5 (in the construction shown in FIG. 14) was 89.5 μm. The coaxial property in Comparison 6 (in the construction shown in FIG. 15) was 98.2 μm. As the results of the developing evaluation, tendencies of uneven development and decrease of resolving power were recognized.

Embodiment 26

First, an aluminum conductive cylindrical support in the construction as shown by a plan view of FIG. 2(*a*) and by side views of FIG. 2(*b*) and (*c*) was prepared. The length and the diameter of a photoconductive layer formed area 1*a* of the conductive cylindrical support 1 were 24.0 cm and 3.0 cm, respectively. The conductive cylindrical support 1 had extruded small diameter portions 1*b* and 1*c* on both the end portions thereof. The length and the diameter of the portions 1*b* and 1*c* were 1.0 cm and 1.0 cm, respectively. The ratio (C/S) of the heat capacity C (cal/°C.) of the conductive cylindrical support and the square measure S ($cm^2$) of the photoconductive layer formed area 1*a* was 0.433 (cal/°C. . $cm^2$).

In the same manner as Embodiment 1, a photoconductive layer 1*m* was formed on the outer periphery of the conductive cylindrical support.

The photoconductor was mounted in a laser beam printer and 3000 sheets in A4 size were output by using a test chart (printing square measure=6.0%) under environmental conditions of 32° C. and 60% RH (at a printing speed of 6 sheets per minute). In this case, C/(S . ω) was 0.217 (cal . s/°C. . $cm^2$. rad). The photoconductor was evaluated with respect to fog of images, presence of abnormality of laser oscillations, and the surface temperature of the photoconductor. The fog of images is represented by the difference in reflectance between a virgin sheet which has not been electrophotograpically developed and a white portion of an output image. The reflectance was measured by using a Minoruta K.K. CR121 type colorimeter.

The fog of images was 0.25%. The surface temperature of the photoconductor was 34.0° C. In addition, no abnormality of laser oscillations took place. Table 2 shows these results.

Embodiment 27

An image was output by using the same photoconductor and in the same conditions as Embodiment 26 except that the printing speed was 4 sheets per minute. As the result, C/(S . ω) was 0.326 (cal . s/°C. . $cm^2$ . rad).

After 3000 sheets were developed, the fog of image was 0.65% and the surface temperature of the photoconductor was 37.5° C. In addition, no abnormality of laser oscillations took place. Table 2 shows these results.

Embodiment 28

A photoconductor was used in the same construction as Embodiment 26 except that a stainless steel (SUS304) conductive cylindrical support was used instead of the aluminum conductive cylindrical support. As the result, the ratio (C/S) of the heat capacity C (cal/°C.) and the square measure S ($cm^2$) of the photoconductive layer formed area 1*a* was 0.720 (cal/°C. . $cm^2$). In addition, an image was output in the same conditions as Embodiment 26. As the result, C/(S . ω) was 0.360 (cal . s/°C. . $cm^2$ . rad).

After 3000 sheets were developed, the fog of image was 0.77% and the surface temperature of the photoconductor was 38.1° C. In addition, no abnormality of laser oscillation took place. Table 2 shows these results.

Embodiment 29

A photoconductor was used in the same construction as Embodiment 26 except that a cast iron conductive cylindrical support which was plated with a nickel group element was used instead of the aluminum conductive cylindrical support. As the result, the ratio (C/S) of the heat capacity C (cal/°C.) and the square measure S ($cm^2$) of the photoconductive layer formed area 1*a* was 0.648 (cal/°C. . $cm^2$). In addition, an image was output in the same conditions as Embodiment 26. As the result, C/(S . ω) was 0.324 (cal . s/°C. . $cm^2$ . rad).

After 3000 sheets were developed, the fog of image was 0.77% and the surface temperature of the photoconductor was 37.3° C. In addition, no abnormality of laser oscillation took place. Table 2 shows these results.

Embodiment 30

A photoconductor was used in the same construction as Embodiment 26 except that the diameter of the photoconductive layer formed area 1*a* of the conductive cylindrical support was 2.0 cm. As the result, the ratio (C/S) of the heat capacity C (cal/°C.) and the square measure S ($cm^2$) of the photoconductive layer formed area 1*a* was 0.289 (cal/°C. . $cm^2$). In addition, an image was output in the same conditions as Embodiment 26 except that the printing speed was 4 sheets per minute. As the result, C/(S . ω) was 0.145 (cal . s/°C. . $cm^2$ . rad).

After 3000 sheets were developed, the fog of image was 0.25% and the surface temperature of the photoconductor was 33.8° C. In addition, no abnormality of laser oscillation took place. Table 2 shows these results.

Embodiment 31

A photoconductor was used in the same conditions as Embodiment 30 except that the photoconductor was made of a stainless steel (SUS304) conductive cylindrical support rather than the aluminum conductive cylindrical support. As the result, the ratio (C/S) of the heat capacity C (cal/°C.) and the square measure S ($cm^2$) of the photoconductive layer formed area 1*a* was 0.480 (cal/°C. . $cm^2$). In addition, an image was output in the same conditions as Embodiment 30. As the result, C/(S . ω) was 0.240 (cal . s/°C. . $cm^2$ . rad).

After 3000 sheets were developed, the fog of image was 0.27% and the surface temperature of the photoconductor was 34.0° C. In addition, no abnormality of laser oscillation took place. Table 2 shows these results.

Embodiment 32

A photoconductor was used in the same conditions as Embodiment 30 except that the photoconductor was made of a cast iron conductive cylindrical support which was plated with a nickel group element rather than the aluminum conductive cylindrical support. As the result, the ratio (C/S) of the heat capacity C (cal/°C.) and the square measure S ($cm^2$) of the photoconductive layer formed area 1*a* was 0.432 (cal/°C. . $cm^2$). In addition, an image was output in the same conditions as Embodiment 30. As the result, C/(S . ω) was 0.216 (cal . s/°C. . $cm^2$ . rad).

After 3000 sheets were developed, the fog of image was 0.28% and the surface temperature of the photoconductor was 34.0° C. In addition, no abnormality of laser oscillation took place. Table 2 shows these results.

Embodiment 33

A photoconductor was used in the same construction as Embodiment 30. An image was output in the same conditions as Embodiment 26 except that the printing speed was 3 sheets per minute. As the result, C/(S . ω) was 0.193 (cal . s/°C. . $cm^2$ . rad).

After 3000 sheets were developed, the fog of image was 0.25% and the surface temperature of the photoconductor was 34.5° C. In addition, no abnormality of laser oscillation took place. Table 2 shows these results.

Embodiment 34

A photoconductor was used in the same construction as Embodiment 31. An image was output in the same conditions as Embodiment 33. As the result, C/(S . ω) was 0.320 (cal . s/°C. . $cm^2$ . rad).

After 3000 sheets were developed, the fog of image was 0.35% and the surface temperature of the photoconductor was 34.8° C. In addition, no abnormality of laser oscillation took place. Table 2 shows these results.

Embodiment 35

A photoconductor was used in the same construction as Embodiment 32. An image was output in the same conditions as Embodiment 33. As the result, C/(S . ω) was 0.288 (cal . s/°C. . $cm^2$ . rad).

After 3000 sheets were developed, the fog of image was 0.40% and the surface temperature of the photoconductor was 34.5° C. In addition, no abnormality of laser oscillation took place. Table 2 shows these results.

Embodiment 36

A photoconductor was used in the same construction as Embodiment 26 except that the diameter of the photoconductive layer formed area 1*a* of the conductive cylindrical support was 1.5 cm. As the result, the ratio (C/S) of the heat capacity C (cal/°C.) and the square measure S ($cm^2$) of the photoconductive layer formed area 1*a* was 0.217 (cal/°C. . $cm^2$). In addition, an image was output in the same conditions as Embodiment 26 except that the printing speed was 4 sheets per minute. As the result, C/(S . ω) was 0.081 (cal . s/°C. . $cm^2$ . rad).

After 3000 sheets were developed, the fog of image was 0.21% and the surface temperature of the photoconductor was 33.8° C. In addition, no abnormality of laser oscillation took place. Table 2 shows these results.

Embodiment 37

A photoconductor was used in the same conditions as Embodiment 36 except that the photoconductor was made of a stainless steel (SUS304) conductive cylindrical support rather than the aluminum conductive cylindrical support. As the result, the ratio (C/S) of the heat capacity C (cal/°C.) and the square measure S ($cm^2$) of the photoconductive layer formed area 1*a* was 0.360 (cal/°C. . $cm^2$). In addition, an image was output in the same conditions as Embodiment 36. As the result, C/(S . ω) was 0.135 (cal . s/°C. . $cm^2$ . rad).

After 3000 sheets were developed, the fog of image was 0.22% and the surface temperature of the photoconductor was 34.2° C. In addition, no abnormality of laser oscillation took place. Table 2 shows these results.

Embodiment 38

A photoconductor was used in the same conditions as Embodiment 36 except that the photoconductor was made of a cast iron conductive cylindrical support which was plated with a nickel group element rather than the aluminum conductive cylindrical support. As the result, the ratio (C/S) of the heat capacity C (cal/°C.) and the square measure S ($cm^2$) of the photoconductive layer formed area 1*a* was 0.324 (cal/°C. . $cm^2$). In addition, an image was output in the same conditions as Embodiment 36. As the result, C/(S . ω) was 0.121 (cal . s/°C. . $cm^2$ . rad).

After 3000 sheets were developed, the fog of image was 0.28% and the surface temperature of the photoconductor was 34.3° C. In addition, no abnormality of laser oscillation took place. Table 2 shows these results.

Embodiment 39

A photoconductor was used in the same construction as Embodiment 36. An image was output in the same conditions as Embodiment 26 except that the printing speed was 2 sheets per minute. As the result, C/(S . ω) was 0.163 (cal . s/°C. . $cm^2$ . rad).

After 3000 sheets were developed, the fog of image was 0.33% and the surface temperature of the photoconductor was 34.8° C. In addition, no abnormality of laser oscillation took place. Table 2 shows these results.

Embodiment 40

A photoconductor was used in the same construction as Embodiment 37. An image was output in the same conditions as Embodiment 39. As the result, C/(S . ω) was 0.271 (cal . s/°C. . $cm^2$ . rad).

After 3000 sheets were developed, the fog of image was 0.38% and the surface temperature of the photoconductor was 35.0° C. In addition, no abnormality of laser oscillation took place. Table 2 shows these results.

Embodiment 41

A photoconductor was used in the same construction as Embodiment 38. An image was output in the same conditions as Embodiment 39. As the result, C/(S . ω) was 0.244 (cal . s/°C. . $cm^2$ . rad).

After 3000 sheets were developed, the fog of image was 0.35% and the surface temperature of the photoconductor was 35.0° C. In addition, no abnormality of laser oscillation took place. Table 2 shows these results.

Embodiment 42

A photoconductor was used in the same construction as Embodiment 36. An image was output in the same conditions as Embodiment 26 except that the printing speed was 1 sheet per minute. As the result, C/(S . ω) was 0.324 (cal . s/°C. . $cm^2$ . rad).

After 3000 sheets were developed, the fog of image was 0.58% and the surface temperature of the photoconductor was 36.8° C. In addition, no abnormality of laser oscillation took place. Table 2 shows these results.

Embodiment 43

A photoconductor was used in the same construction as Embodiment 26 except that the diameter of the photoconductive layer formed area 1*a* of the conductive cylindrical support was 1.0 cm and the diameter of both the end portions was 0.5 cm. As the result, the ratio (C/S) of the heat capacity C (cal/°C.) and the square measure S ($cm^2$) of the photoconductive layer formed area 1*a* was 0.144 (cal/°C. . $cm^2$). In addition, an image was output in the same conditions as Embodiment 26 except that the printing speed was 4 sheets per minute. As the result, C/(S . ω) was 0.036 (cal . s/°C. . $cm^2$ . rad).

After 3000 sheets were developed, the fog of image was 0.20% and the surface temperature of the photoconductor was 33.8° C. In addition, no abnormality of laser oscillation took place. Table 2 shows these results.

Embodiment 44

A photoconductor was used in the same conditions as Embodiment 43 except that the photoconductor was made of a stainless steel (SUS304) conductive cylindrical support rather than the aluminum conductive cylindrical support. As the result, the ratio (C/S) of the heat capacity C (cal/°C.) and the square measure S ($cm^2$) of the photoconductive layer formed area 1*a* was 0.240 (cal/°C. . $cm^2$). In addition, an image was output in the same conditions as Embodiment 43. As the result, C/(S . ω) was 0.060 (cal . s/°C. . $cm^2$ . rad).

After 3000 sheets were developed, the fog of image was 0.18% and the surface temperature of the photoconductor was 34.0° C. In addition, no abnormality of laser oscillation took place. Table 2 shows these results.

Embodiment 45

A photoconductor was used in the same conditions as Embodiment 43 except that the photoconductor was made of a cast iron conductive cylindrical support which was plated with a nickel group element rather than the aluminum conductive cylindrical support. As the result, the ratio (C/S) of the heat capacity C (cal/°C.) and the square measure S ($cm^2$) of the photoconductive layer formed area 1*a* was 0.216 (cal/°C. . $cm^2$). In addition, an image was output in the same conditions as Embodiment 43. As the result, C/(S . ω) was 0.054 (cal . s/°C. . $cm^2$ . rad).

After 3000 sheets were developed, the fog of image was 0.22% and the surface temperature of the photoconductor was 34.0° C. In addition, no abnormality of laser oscillation took place. Table 2 shows these results.

Embodiment 46

A photoconductor was used in the same construction as Embodiment 43. An image was output in the same conditions as Embodiment 26 except that the printing speed was 3 sheets per minute. As the result, C/(S . ω) was 0.048 (cal . s/°C. . $cm^2$ . rad).

After 3000 sheets were developed, the fog of image was 0.23% and the surface temperature of the photoconductor was 33.8° C. In addition, no abnormality of laser oscillation took place. Table 2 shows these results.

Embodiment 47

A photoconductor was used in the same construction as Embodiment 44. An image was output in the same conditions as Embodiment 46. As the result, C/(S . ω) was 0.080 (cal . s/°C. cm$^2$ . rad).

After 3000 sheets were developed, the fog of image was 0.25% and the surface temperature of the photoconductor was 34.0° C. In addition, no abnormality of laser oscillation took place. Table 2 shows these results.

Embodiment 48

A photoconductor was used in the same construction as Embodiment 45. An image was output in the same conditions as Embodiment 46. As the result, C/(S . ω) was 0.072 (cal . s/°C. . cm$^2$ . rad).

After 3000 sheets were developed, the fog of image was 0.26% and the surface temperature of the photoconductor was 34.0° C. In addition, no abnormality of laser oscillation took place. Table 2 shows these results.

Embodiment 49

A photoconductor was used in the same construction as Embodiment 43. An image was output in the same conditions as Embodiment 26 except that the printing speed was 2 sheets per minute. As the result, C/(S . ω) was 0.072 (cal . s/°C. . cm$^2$ . rad).

After 3000 sheets were developed, the fog of image was 0.26% and the surface temperature of the photoconductor was 33.8° C. In addition, no abnormality of laser oscillation took place. Table 2 shows these results.

Embodiment 50

A photoconductor was used in the same construction as Embodiment 44. An image was output in the same conditions as Embodiment 49. As the result, C/(S . ω) was 0.120 (cal . s/°C. . cm$^2$ . rad).

After 3000 sheets were developed, the fog of image was 0.34% and the surface temperature of the photoconductor was 34.5° C. In addition, no abnormality of laser oscillation took place. Table 2 shows these results.

Embodiment 51

A photoconductor was used in the same construction as Embodiment 45. An image was output in the same conditions as Embodiment 49. As the result, C/(S . ω) was 0.108 (cal . s/°C. . cm$^2$ . rad).

After 3000 sheets were developed, the fog of image was 0.38% and the surface temperature of the photoconductor was 34.3° C. In addition, no abnormality of laser oscillation took place. Table 2 shows these results.

Embodiment 52

A photoconductor was used in the same construction as Embodiment 43. An image was output in the same conditions as Embodiment 26 except that the printing speed was 1 sheet per minute. As the result, C/(S . ω) was 0.144 (cal . s/°C. . cm$^2$ . rad).

After 3000 sheets were developed, the fog of image was 0.38% and the surface temperature of the photoconductor was 34.8° C. In addition, no abnormality of laser oscillation took place. Table 3 shows these results.

Embodiment 53

A photoconductor was used in the same construction as Embodiment 44. An image was output in the same conditions as Embodiment 52. As the result, C/(S . ω) was 0.240 (cal . s/°C. . cm$^2$ . rad).

After 3000 sheets were developed, the fog of image was 0.35% and the surface temperature of the photoconductor was 35.0° C. In addition, no abnormality of laser oscillation took place. Table 3 shows these results.

Embodiment 54

A photoconductor was used in the same construction as Embodiment 45. An image was output in the same conditions as Embodiment 52. As the result, C/(S . ω) was 0.216 (cal . s/°C. . cm$^2$ . rad).

After 3000 sheets were developed, the fog of image was 0.34% and the surface temperature of the photoconductor was 34.7° C. In addition, no abnormality of laser oscillation took place. Table 3 shows these results.

Embodiment 55

A photoconductor was used in the same construction as Embodiment 26 except that the diameter of the photoconductive layer formed area 1*a* of the conductive cylindrical support was 0.5 cm and the diameter of both the end portions was 0.3 cm. As the result, the ratio (C/S) of the heat capacity C (cal/°C.) and the square measure S (cm$^2$) of the photoconductive layer formed area 1*a* was 0.072 (cal/°C. . cm$^2$). In addition, an image was output in the same conditions as Embodiment 26 except that the printing speed was 3 sheets per minute. As the result, C/(S . ω) was 0.012 (cal . s/°C. . cm$^2$ . rad).

After 3000 sheets were developed, the fog of image was 0.14% and the surface temperature of the photoconductor was 34.0° C. In addition, no abnormality of laser oscillation took place. Table 3 shows these results.

Embodiment 56

A photoconductor was used in the same conditions as Embodiment 55 except that the photoconductor was made of a stainless steel (SUS304) conductive cylindrical support rather than the aluminum conductive cylindrical support. As the result, the ratio (C/S) of the heat capacity C (cal/°C.) and the square measure S (cm$^2$) of the photoconductive layer formed area 1*a* was 0.120 (cal/°C. . cm$^2$). In addition, an image was output in the same conditions as Embodiment 55. As the result, C/(S . ω) was 0.020 (cal . s/°C. . cm$^2$ . rad).

After 3000 sheets were developed, the fog of image was 0.18% and the surface temperature of the photoconductor was 34.1° C. In addition, no abnormality of laser oscillation took place. Table 3 shows these results.

Embodiment 57

A photoconductor was used in the same conditions as Embodiment 55 except that the photoconductor was made of a cast iron conductive cylindrical support which was plated with a nickel group element rather than the aluminum conductive cylindrical support. As the result, the ratio (C/S) of the heat capacity C (cal/°C.) and the square measure S (cm$^2$) of the photoconductive layer formed area 1*a* was 0.108 (cal/°C. . cm$^2$). In addition, an image was output in the same conditions as Embodiment 55. As the result, C/(S . ω) was 0.018 (cal . s/°C. . cm$^2$ . rad).

After 3000 sheets were developed, the fog of image was 0.18% and the surface temperature of the photoconductor was 33.9° C. In addition, no abnormality of laser oscillation took place. Table 3 shows these results.

Embodiment 58

A photoconductor was used in the same construction as Embodiment 55. An image was output in the same conditions as Embodiment 26 except that the printing speed was 2 sheets per minute. As the result, C/(S . ω) was 0.018 (cal . s/°C. . $cm^2$ . rad).

After 3000 sheets were developed, the fog of image was 0.10% and the surface temperature of the photoconductor was 33.5° C. In addition, no abnormality of laser oscillation took place. Table 3 shows these results.

Embodiment 59

A photoconductor was used in the same construction as Embodiment 56. An image was output in the same conditions as Embodiment 58. As the result, C/(S . ω) was 0.030 (cal . s/°C. . $cm^2$ . rad).

After 3000 sheets were developed, the fog of image was 0.18% and the surface temperature of the photoconductor was 34.0° C. In addition, no abnormality of laser oscillation took place. Table 3 shows these results.

Embodiment 60

A photoconductor was used in the same construction as Embodiment 57. An image was output in the same conditions as Embodiment 58. As the result, C/(S . ω) was 0.027 (cal . s/°C. . $cm^2$ . rad).

After 3000 sheets were developed, the fog of image was 0.16% and the surface temperature of the photoconductor was 33.7° C. In addition, no abnormality of laser oscillation took place. Table 3 shows these results.

Embodiment 61

A photoconductor was used in the same construction as Embodiment 55. An image was output in the same conditions as Embodiment 26 except that the printing speed was 1 sheet per minute. As the result, C/(S . ω) was 0.036 (cal . s/°C. . $cm^2$ . rad).

After 3000 sheets were developed, the fog of image was 0.17% and the surface temperature of the photoconductor was 33.8° C. In addition, no abnormality of laser oscillation took place. Table 3 shows these results.

Embodiment 62

A photoconductor was used in the same construction as Embodiment 56. An image was output in the same conditions as Embodiment 61. As the result, C/(S . ω) was 0.060 (cal . s/°C. . $cm^2$ . rad).

After 3000 sheets were developed, the fog of image was 0.20% and the surface temperature of the photoconductor was 34.0° C. In addition, no abnormality of laser oscillation took place. Table 3 shows these results.

Embodiment 63

A photoconductor was used in the same construction as Embodiment 57. An image was output in the same conditions as Embodiment 61. As the result, C/(S . ω) was 0.054 (cal . s/°C. . $cm^2$ . rad).

After 3000 sheets were developed, the fog of image was 0.16% and the surface temperature of the photoconductor was 33.7° C. In addition, no abnormality of laser oscillation took place. Table 3 shows these results.

Comparison 7

A photoconductor was used in the same construction as Embodiment 26. An image was output in the same conditions as Embodiment 26 except that the printing speed was 2 sheets per minute. As the result, C/(S . ω) was 0.646 (cal . s/°C. . $cm^2$ . rad).

After 1870 sheets were developed, the fog of image was 4.02% and the surface temperature of the photoconductor was 48.8° C. In addition, the laser oscillations stopped when 1900 sheets were developed. Table 3 shows these results.

Comparison 8

A photoconductor was used in the same construction as Embodiment 28. An image was output in the same conditions as Embodiment 26 except that the printing speed was 4 sheets per minute. As the result, C/(S . ω) was 0.541 (cal . s/°C. . $cm^2$ . rad).

After 2430 sheets were developed, the fog of image was 3.25% and the surface temperature of the photoconductor was 47.1° C. In addition, the laser oscillations stopped when 2500 sheets were developed. Table 3 shows these results.

Comparison 9

A photoconductor was used in the same construction as Embodiment 29. An image was output in the same conditions as Embodiment 26 except that the printing speed was 4 sheets per minute. As the result, C/(S . ω) was 0.487 (cal . s/°C. . $cm^2$ . rad).

After 2150 sheets were developed, the fog of image was 3.01% and the surface temperature of the photoconductor was 46.8° C. In addition, the laser oscillations stopped when 2200 sheets were developed. Table 3 shows these results.

Comparison 10

A photoconductor was used in the same construction as Embodiment 28. An image was output in the same conditions as Embodiment 26 except that the printing speed was 3 sheets per minute. As the result, C/(S . ω) was 0.720 (cal . s/°C. . $cm^2$ . rad).

After 1810 sheets were developed, the fog of image was 5.25% and the surface temperature of the photoconductor was 51.0° C. In addition, the laser oscillations stopped when 1800 sheets were developed. Table 3 shows these results.

Comparison 11

A photoconductor was used in the same construction as Embodiment 29. An image was output in the same conditions as Embodiment 26 except that the printing speed was 3 sheets per minute. As the result, C/(S . ω) was 0.648 (cal . s/°C. . $cm^2$ . rad).

After 1980 sheets were developed, the fog of image was 4.20% and the surface temperature of the photoconductor was 49.0° C. In addition, the laser oscillations stopped when 2000 sheets were developed. Table 3 shows these results.

Comparison 12

A photoconductor was used in the same construction as Embodiment 28. An image was output in the same conditions as Embodiment 26 except that the printing speed was 2 sheets per minute. As the result, C/(S . ω) was 1.075 (cal . s/°C. . $cm^2$ . rad).

After 1680 sheets were developed, the fog of image was 5.88% and the surface temperature of the photoconductor was 52.0° C. In addition, the laser oscillations stopped when 1700 sheets were developed. Table 3 shows these results.

Comparison 13

A photoconductor was used in the same construction as Embodiment 29. An image was output in the same conditions as Embodiment 26 except that the printing speed was 2 sheets per minute. As the result, C/(S . ω) was 0.967 (cal . s/°C. . cm$^2$ . rad).

After 1720 sheets were developed, the fog of image was 5.28% and the surface temperature of the photoconductor was 51.8° C. In addition, the laser oscillations stopped when 1700 sheets were developed. Table 3 shows these results.

Comparison 14

A photoconductor was used in the same construction as Embodiment 30. An image was output in the same conditions as Embodiment 26 except that the printing speed was 1 sheet per minute. As the result, C/(S . ω) was 0.578 (cal . s/°C. . cm$^2$ . rad).

After 1890 sheets were developed, the fog of image was 3.42% and the surface temperature of the photoconductor was 47.6° C. In addition, the laser oscillations stopped when 19000 sheets were developed. Table 3 shows these results.

Comparison 15

A photoconductor was used in the same construction as Embodiment 31. An image was output in the same conditions as Embodiment 26 except that the printing speed was 2 sheets per minute. As the result, C/(S . ω) was 0.480 (cal . s/°C. . cm$^2$ . rad).

After 2230 sheets were developed, the fog of image was 2.99% and the surface temperature of the photoconductor was 47.0° C. In addition, the laser oscillations stopped when 2200 sheets were developed. Table 3 shows these results.

Comparison 16

A photoconductor was used in the same construction as Embodiment 32. An image was output in the same conditions as Embodiment 26 except that the printing speed was 2 sheets per minute. As the result, C/(S . ω) was 0.432 (cal . s/°C. . cm$^2$ . rad).

After 2210 sheets were developed, the fog of image was 2.87% and the surface temperature of the photoconductor was 46.7° C. In addition, the laser oscillations stopped when 2200 sheets were developed. Table 3 shows these results.

Comparison 17

A photoconductor was used in the same construction as Embodiment 31. An image was output in the same conditions as Embodiment 26 except that the printing speed was 1 sheet per minute. As the result, C/(S . ω) was 0.960 (cal . s/°C. . cm$^2$ . rad).

After 1740 sheets were developed, the fog of image was 5.20% and the surface temperature of the photoconductor was 51.7° C. In addition, the laser oscillations stopped when 1700 sheets were developed. Table 3 shows these results.

Comparison 18

A photoconductor was used in the same construction as Embodiment 32. An image was output in the same conditions as Embodiment 26 except that the printing speed was 1 sheet per minute. As the result, C/(S . ω) was 0.864 (cal . s/°C. . cm$^2$ . rad).

After 1880 sheets were developed, the fog of image was 4.77% and the surface temperature of the photoconductor was 50.3° C. In addition, the laser oscillations stopped when 1900 sheets were developed. Table 3 shows these results.

Comparison 19

A photoconductor was used in the same construction as Embodiment 37. An image was output in the same conditions as Embodiment 26 except that the printing speed was 1 sheet per minute. As the result, C/(S . ω) was 0.537 (cal . s/°C. . cm$^2$ . rad).

After 2300 sheets were developed, the fog of image was 3.33% and the surface temperature of the photoconductor was 47.0° C. In addition, the laser oscillations stopped when 2300 sheets were developed. Table 3 shows these results.

Comparison 20

A photoconductor was used in the same construction as Embodiment 38. An image was output in the same conditions as Embodiment 26 except that the printing speed was 1 sheet per minute. As the result, C/(S . ω) was 0.484 (cal . s/°C. . cm$^2$ . rad).

After 2200 sheets were developed, the fog of image was 3.25% and the surface temperature of the photoconductor was 47.0° C. In addition, the laser oscillations stopped when 2200 sheets were developed. Table 3 shows these results.

Embodiment 64

An aluminum conductive cylindrical support was used in the construction as shown by a plan view of FIG. 2(*a*) and by side views of FIG. 2(*b*) and (*c*). The length and the diameter of the photoconductive layer formed area 1*a* of the conductive cylindrical support were 24.0 cm and 1.5 cm, respectively. The conductive cylindrical support had extruded small diameter portions 1*b* and 1*c* at both the end portions thereof. The length and the diameter of the portions 1*b* and 1*c* were 1.0 cm and 1.0 cm, respectively. The radius of curvature r of the conductive cylindrical support was 0.75 cm.

A photoconductive layer 1*m* was formed on the outer periphery of the conductive cylindrical support in the same manner as Embodiment 1.

A photoconductor having the three-layered photoconductive layer 1*m* was mounted in an electrophotographic LED printer. An electrostatic latent image on the photoconductor was measured so as to evaluate unevenness of image in the vertical scanning direction in accordance with a method formulated by Miyasaka et. al. ("Japan Hardcopy '90 Thesis Collection, EP-37P). In other words, by using a measuring electrode with a diameter of 50 μm and keeping the distance between the electrode and the photoconductor for 30 μm, the printer was operated at the process speed equivalent to 6 sheets per minute in A4 size (p=2.96 cm/s). Thereafter, just after an image was exposed (1 second later), the resolution of an electrostatic latent image in the vertical scanning direction was measured. According to this method, an electrostatic latent image can be measured at a resolution of 500 dpi. Table 4 shows these results.

Embodiment 65

A photoconductor was used in the same construction as Embodiment 64. The printer was operated at the process speed equivalent to 4 sheets per minute in A4 size (p=1.97 cm/s). Thereafter, just after an image was exposed (1 second later), the resolution of an electrostatic latent image in the vertical scanning direction was measured. Table 4 shows these results.

Embodiment 66

A photoconductor was used in the same construction as Embodiment 64. The printer was operated at the process speed equivalent to 2 sheets per minute in A4 size (p=0.99 cm/s). Thereafter, just after an image was exposed (1 second later), the resolution of an electrostatic latent image in the vertical scanning direction was measured. Table 4 shows these results.

Embodiment 67

A photoconductor was used in the same construction as Embodiment 64. The printer was operated at the process speed equivalent to 1 sheet per minute in A4 size (p=0.49 cm/s). Thereafter, just after an image was exposed (1 second later), the resolution of an electrostatic latent image in the vertical scanning direction was measured. Table 4 shows these results.

Embodiment 68

A photoconductor was used in the same construction as Embodiment 64 except that the diameter of the photoconductive layer formed area 1*a* was 1.0 cm, that the diameter of both end portions thereof was 0.5 cm, and that the radius of curvature r of the conductive cylindrical support was 0.50 cm.

Thereafter, the printer was operated at the process speed equivalent to 6 sheets per minute in A4 size (p=2.96 cm/s). Thereafter, just after an image was exposed (1 second later), the resolution of an electrostatic latent image in the vertical scanning direction was measured. Table 4 shows these results.

Embodiment 69

A photoconductor was used in the same construction as Embodiment 68. The printer was operated at the process speed equivalent to 4 sheets per minute in A4 size (p=1.96 cm/s). Thereafter, just after an image was exposed (1 second later), the resolution of an electrostatic latent image in the vertical scanning direction was measured. Table 4 shows these results.

Embodiment 70

A photoconductor was used in the same construction as Embodiment 68. The printer was operated at the process speed equivalent to 2 sheets per minute in A4 size (p=0.99 cm/s). Thereafter, just after an image was exposed (1 second later), the resolution of an electrostatic latent image in the vertical scanning direction was measured. Table 4 shows these results.

Embodiment 71

A photoconductor was used in the same construction as Embodiment 68. The printer was operated at the process speed equivalent to 1 sheet per minute in A4 size (p=0.49 cm/s). Thereafter, just after an image was exposed (1 second later), the resolution of an electrostatic latent image in the vertical scanning direction was measured. Table 4 shows these results.

Embodiment 72

A photoconductor was used in the same construction as Embodiment 64 except that the diameter of the photoconductive layer formed area 1*a* was 0.5 cm, that the diameter of both end portions thereof was 0.3 cm, and that the radius of curvature r of the conductive cylindrical support was 0.25 cm.

Thereafter, the printer was operated at the process speed equivalent to 6 sheets per minute in A4 size (p=2.96 cm/s). Thereafter, just after an image was exposed (1 second later), the resolution of an electrostatic latent image in the vertical scanning direction was measured. Table 4 shows these results.

Embodiment 73

A photoconductor was used in the same construction as Embodiment 72. The printer was operated at the process speed equivalent to 4 sheets per minute in A4 size (p=1.96 cm/s). Thereafter, just after an image was exposed (1 second later), the resolution of an electrostatic latent image in the vertical scanning direction was measured. Table 4 shows these results.

Embodiment 74

A photoconductor was used in the same construction as Embodiment 72. The printer was operated at the process speed equivalent to 2 sheets per minute in A4 size (p=0.99 cm/s). Thereafter, just after an image was exposed (1 second later), the resolution of an electrostatic latent image in the vertical scanning direction was measured. Table 4 shows these results.

Embodiment 75

A photoconductor was used in the same construction as Embodiment 72. The printer was operated at the process speed equivalent to 1 sheet per minute in A4 size (p=0.49 cm/s). Thereafter, just after an image was exposed (1 second later), the resolution of an electrostatic latent image in the vertical scanning direction was measured. Table 4 shows these results.

Reference 1

A photoconductor was used in the same construction as Embodiment 64 except that the diameter of the photoconductive layer formed area 1*a* was 3.0 cm, that the diameter of both end portions thereof was 1.0 cm, and that the radius of curvature r of the conductive cylindrical support was 1.50 cm.

Thereafter, the printer was operated at the process speed equivalent to 6 sheets per minute in A4 size (p=2.96 cm/s). Thereafter, just after an image was exposed (1 second later), the resolution of an electrostatic latent image in the vertical scanning direction was measured. Table 4 shows these results.

Reference 2

A photoconductor was used in the same construction as Embodiment 64 except that the diameter of the photoconductive layer formed area 1*a* was 2.0 cm, that the diameter of both end portions thereof was 1.0 cm, and that the radius of curvature r of the conductive cylindrical support was 1.00 cm.

Thereafter, the printer was operated at the process speed equivalent to 6 sheets per minute in A4 size (p=2.96 cm/s). Thereafter, just after an image was exposed (1 second later), the resolution of an electrostatic latent image in the vertical scanning direction was measured. Table 4 shows these results.

Reference 3

A photoconductor was used in the same construction as Embodiment 64 except that the diameter of the photoconductive layer formed area 1*a* was 1.5 cm, that the diameter of both end portions thereof was 1.0 cm, and that the radius of curvature r of the conductive cylindrical support was 0.75 cm.

Thereafter, the printer was operated at the process speed equivalent to 12 sheets per minute in A4 size (p=5.96 cm/s). Thereafter, just after an image was exposed (1 second later), the resolution of an electrostatic latent image in the vertical scanning direction was measured. Table 4 shows these results.

As shown in Table 4, when the radius of curvature r of a conductive cylindrical support is 0.75 cm or less and the relation of $r \cdot p \leqq 2.3$ is satisfied (where r (cm) is the radius of curvature and p (cm/s) is a peripheral speed of a photoconductor in operation), in other words, in Embodiment 64 to 74, it is obvious that the resolution of an electrostatic latent image in the vertical direction is improved. In contrast, it was verified that the resolution of the electrostatic latent image in the vertical scanning direction in References 1 to 3, where the above relation is not satisfied are lower than that in Embodiments 64 to 75.

TABLE 1

| | MATERIAL | DIAMETER (g · cm) | LENGTH (cm) | MOMENT OF INERTIA (g · cm²) | STANDARD DEVIATION OF UNEVENNESS IN VERTICAL SCANNING DIRECTION (mm) | HOURS UNTIL OCCURRENCE OF ABNORMALITY (Hr) |
|---|---|---|---|---|---|---|
| EMBODIMENT 1 | A | 1.5 | 24.0 | 32.2 | 0.04 | 36 HOURS OR MORE |
| EMBODIMENT 2 | B | 1.5 | 24.0 | 93.8 | 0.01 | 36 HOURS OR MORE |
| EMBODIMENT 3 | C | 1.5 | 24.0 | 85.4 | 0.01 | 36 HOURS OR MORE |
| EMBODIMENT 4 | A | 1.5 | 33.0 | 44.3 | 0.01 | 36 HOURS OR MORE |
| EMBODIMENT 5 | B | 1.5 | 33.0 | 128.9 | 0.01 | 36 HOURS OR MORE |
| EMBODIMENT 6 | C | 1.5 | 33.0 | 131.2 | 0.02 | 36 HOURS OR MORE |
| EMBODIMENT 7 | A | 1.0 | 24.0 | 6.10 | 0.04 | 36 HOURS OR MORE |
| EMBODIMENT 8 | B | 1.0 | 24.0 | 17.7 | 0.02 | 36 HOURS OR MORE |
| EMBODIMENT 9 | C | 1.0 | 24.0 | 18.8 | 0.02 | 36 HOURS OR MORE |
| EMBODIMENT 10 | A | 1.0 | 33.0 | 8.70 | 0.03 | 36 HOURS OR MORE |
| EMBODIMENT 11 | B | 1.0 | 33.0 | 25.5 | 0.02 | 36 HOURS OR MORE |
| EMBODIMENT 12 | C | 1.0 | 33.0 | 25.9 | 0.02 | 36 HOURS OR MORE |
| COMPARISON 1 | B | 2.0 | 24.0 | 296.3 | 0.01 | 2.5 HOURS |
| COMPARISON 2 | C | 2.0 | 24.0 | 301.6 | 0.01 | 3.0 HOURS |
| COMPARISON 3 | A | 1.5 | 24.0 | 1.99 | 0.34 | 36 HOURS OR MORE |
| COMPARISON 4 | A | 1.0 | 24.0 | 0.824 | 0.47 | 36 HOURS OR MORE |

NOTE
1: IN COMPARISONS 3 AND 4, SUPPORTING BODIES ARE HOLLOWED-MATERIALS WITH THE THICKNESS OF 0.1 cm.
2: MATERIALS A, B, AND C REPRESENT ALUMINUM, Ni PLATED CAST IRON, AND STAINLESS STEEL (SUS304), RESPECTIVELY.
3: AS CHARACTERISTICS OF MATERIALS A, B, AND C, THE FOLLWING VALUES ARE USED.

| MATERIAL | SPECIFIC HEAT (cal/g · °C.) | DENSITY (g/cm³) |
|---|---|---|
| A | 0.214 | 2.7 |
| B | 0.11 | 7.86 |
| C | 0.12 | 8.0 |

TABLE 2

| EMBODIMENT | C/S (cal/°C. · cm²) | PRINTING SPEED (SHEETS/min) | ANGULAR VELOCITY OF PHOTO-CONDUCTIVE CYLINDRICAL SUPPORT (rad/s) | C/(S · ω) (cal · s/°C. cm² · rad) | FOG OF IMAGE (%) | SURFACE TEMPERATURE OF PHOTO-CONDUCTIVE LAYER (°C.) | PRESENCE OF ABSENCE OF ABNORMALITY OF LASER OSCILLATIONS |
|---|---|---|---|---|---|---|---|
| 26 | 0.433 | 6 | 2.00 | 0.217 | 0.25 | 34.0 | ABSENCE |
| 27 | 0.433 | 4 | 1.33 | 0.326 | 0.65 | 37.5 | ABSENCE |
| 28 | 0.726 | 6 | 2.00 | 0.360 | 0.77 | 38.1 | ABSENCE |
| 29 | 0.648 | 6 | 2.00 | 0.324 | 0.63 | 37.3 | ABSENCE |
| 30 | 0.289 | 4 | 2.00 | 0.145 | 0.25 | 33.8 | ABSENCE |
| 31 | 0.480 | 4 | 2.00 | 0.240 | 0.27 | 34.0 | ABSENCE |
| 32 | 0.432 | 4 | 2.00 | 0.216 | 0.28 | 34.0 | ABSENCE |
| 33 | 0.289 | 3 | 1.50 | 0.193 | 0.25 | 34.5 | ABSENCE |
| 34 | 0.480 | 3 | 1.50 | 0.320 | 0.35 | 34.8 | ABSENCE |
| 35 | 0.432 | 3 | 1.50 | 0.288 | 0.40 | 34.5 | ABSENCE |
| 36 | 0.217 | 4 | 2.67 | 0.081 | 0.21 | 33.8 | ABSENCE |
| 37 | 0.360 | 4 | 2.67 | 0.135 | 0.22 | 34.2 | ABSENCE |
| 38 | 0.324 | 4 | 2.67 | 0.121 | 0.28 | 34.3 | ABSENCE |
| 39 | 0.217 | 2 | 1.33 | 0.163 | 0.33 | 34.8 | ABSENCE |
| 40 | 0.360 | 2 | 1.33 | 0.271 | 0.38 | 35.0 | ABSENCE |
| 41 | 0.324 | 2 | 1.33 | 0.244 | 0.35 | 35.0 | ABSENCE |
| 42 | 0.217 | 1 | 0.67 | 0.324 | 0.58 | 36.8 | ABSENCE |
| 43 | 0.144 | 4 | 4.00 | 0.036 | 0.20 | 33.8 | ABSENCE |
| 44 | 0.240 | 4 | 4.00 | 0.060 | 0.18 | 34.0 | ABSENCE |
| 45 | 0.216 | 4 | 4.00 | 0.054 | 0.22 | 34.0 | ABSENCE |
| 46 | 0.144 | 3 | 3.00 | 0.048 | 0.23 | 33.8 | ABSENCE |
| 47 | 0.240 | 3 | 3.00 | 0.080 | 0.25 | 34.0 | ABSENCE |
| 48 | 0.216 | 3 | 3.00 | 0.072 | 0.26 | 34.0 | ABSENCE |
| 49 | 0.144 | 2 | 2.00 | 0.072 | 0.26 | 33.8 | ABSENCE |
| 50 | 0.240 | 2 | 2.00 | 0.120 | 0.34 | 34.5 | ABSENCE |

TABLE 2-continued

| | C/S (cal/°C. · cm²) | PRINTING SPEED (SHEETS/ min) | ANGULAR VELOCITY OF PHOTO-CONDUCTIVE CYLINDRICAL SUPPORT (rad/s) | C/(S · ω) (cal · s/°C. cm² · rad) | FOG OF IMAGE (%) | SURFACE TEMPERATURE OF PHOTO-CONDUCTIVE LAYER (°C.) | PRESENCE OF ABSENCE OF ABNORMALITY OF LASER OSCILLATIONS |
|---|---|---|---|---|---|---|---|
| 51 | 0.216 | 2 | 2.00 | 0.108 | 0.38 | 34.3 | ABSENCE |

TABLE 3

| | C/S (cal/°C. · cm²) | PRINTING SPEED (SHEETS/ min) | ANGULAR VELOCITY OF PHOTO-CONDUCTIVE CYLINDRICAL SUPPORT (rad/s) | C/(S · ω) (cal · s/°C. cm² · rad) | FOG OF IMAGE (%) | SURFACE TEMPERATURE OF PHOTO-CONDUCTIVE LAYER (°C.) | PRESENCE OF ABSENCE OF ABNORMALITY OF LASER OSCILLATIONS |
|---|---|---|---|---|---|---|---|
| EMBODIMENT | | | | | | | |
| 52 | 0.144 | 1 | 1.00 | 0.144 | 0.38 | 34.8 | ABSENCE |
| 53 | 0.240 | 1 | 1.00 | 0.240 | 0.35 | 35.0 | ABSENCE |
| 54 | 0.216 | 1 | 1.00 | 0.216 | 0.34 | 34.7 | ABSENCE |
| 55 | 0.072 | 3 | 6.00 | 0.012 | 0.14 | 34.0 | ABSENCE |
| 56 | 0.120 | 3 | 6.00 | 0.020 | 0.18 | 34.1 | ABSENCE |
| 57 | 0.108 | 3 | 6.00 | 0.018 | 0.18 | 33.9 | ABSENCE |
| 58 | 0.072 | 2 | 4.00 | 0.018 | 0.10 | 33.5 | ABSENCE |
| 59 | 0.120 | 2 | 4.00 | 0.030 | 0.18 | 34.0 | ABSENCE |
| 60 | 0.108 | 2 | 4.00 | 0.027 | 0.16 | 33.7 | ABSENCE |
| 61 | 0.072 | 1 | 2.00 | 0.036 | 0.17 | 33.8 | ABSENCE |
| 62 | 0.120 | 1 | 2.00 | 0.060 | 0.20 | 34.0 | ABSENCE |
| 63 | 0.108 | 1 | 2.00 | 0.054 | 0.16 | 33.7 | ABSENCE |
| COMPARISON | | | | | | | |
| 7 | 0.433 | 2 | 0.67 | 0.646 | 4.02 | 48.8 | PRESENCE |
| 8 | 0.720 | 4 | 1.33 | 0.541 | 3.25 | 47.1 | PRESENCE |
| 9 | 0.648 | 4 | 1.33 | 0.487 | 3.01 | 46.8 | PRESENCE |
| 10 | 0.720 | 3 | 1.00 | 0.720 | 5.25 | 51.0 | PRESENCE |
| 11 | 0.648 | 3 | 1.00 | 0.648 | 4.20 | 49.0 | PRESENCE |
| 12 | 0.720 | 2 | 0.67 | 1.075 | 5.88 | 52.0 | PRESENCE |
| 13 | 0.648 | 2 | 0.67 | 0.967 | 5.28 | 51.8 | PRESENCE |
| 14 | 0.289 | 1 | 0.50 | 0.578 | 3.42 | 47.6 | PRESENCE |
| 15 | 0.480 | 2 | 1.00 | 0.480 | 2.99 | 47.0 | PRESENCE |
| 16 | 0.432 | 2 | 1.00 | 0.432 | 2.87 | 46.7 | PRESENCE |
| 17 | 0.480 | 1 | 0.50 | 0.960 | 5.20 | 51.7 | PRESENCE |
| 18 | 0.432 | 1 | 0.50 | 0.864 | 4.77 | 50.3 | PRESENCE |
| 19 | 0.360 | 1 | 0.67 | 0.537 | 3.33 | 47.0 | PRESENCE |
| 20 | 0.324 | 1 | 0.67 | 0.484 | 3.25 | 47.0 | PRESENCE |

TABLE 4

| | RADIUS OF CURVATURE r (cm) | PERIPHERAL SPEED (cm/s) | r · p (cm · cm/s) | RESOLUTION (dpi) |
|---|---|---|---|---|
| EMBODIMENT | | | | |
| 64 | 0.75 | 2.96 | 2.22 | 440 |
| 65 | 0.75 | 1.97 | 1.478 | 445 |
| 66 | 0.75 | 0.99 | 0.743 | 450 |
| 67 | 0.75 | 0.49 | 0.367 | 452 |
| 68 | 0.50 | 2.96 | 1.48 | 443 |
| 69 | 0.50 | 1.97 | 0.985 | 446 |
| 70 | 0.50 | 0.99 | 0.495 | 451 |
| 71 | 0.50 | 0.49 | 0.245 | 455 |
| 72 | 0.25 | 2.96 | 0.74 | 448 |
| 73 | 0.25 | 1.97 | 0.493 | 452 |
| 74 | 0.25 | 0.99 | 0.247 | 450 |
| 75 | 0.25 | 0.49 | 0.123 | 475 |
| REFERENCE | | | | |
| 1 | 1.50 | 2.96 | 4.44 | 330 |
| 2 | 1.00 | 2.96 | 2.96 | 338 |
| 3 | 0.75 | 5.92 | 4.44 | 325 |

What is claimed is:

1. A photoconductor comprising:

a solid non-hollow conductive cylindrical support made of a single solid material; and a photoconductive layer formed on an outer periphery of said non-hollow conductive cylindrical support.

2. A photoconductor comprising:

a solid non-hollow conductive cylindrical support made of a single solid material;

a photoconductive layer formed on an outer periphery of said non-hollow conductive cylindrical support; and an extruded drive transferring mechanism extending from an end portion of said non-hollow conductive cylindrical support, said extruded drive transferring mechanism being coaxially and integrally provided in a unified manner on said end portion of said non-hollow conductive cylindrical support, the diameter of said mechanism being smaller than that of said conductive cylindrical support.

3. A photoconductor comprising:

a solid non-hollow conductive cylindrical support made of a single solid material;

a photoconductive layer formed on an outer periphery of said non-hollow conductive cylindrical support; and an extruded drive transferring mechanism extending from both end portions of said non-hollow conductive cylindrical support, said extruded drive transferring mechanism being coaxially and integrally provided in a unified manner on said end portions of said non-hollow conductive cylindrical support, the diameter of said mechanism being smaller than that of said non-hollow conductive cylindrical support.

4. The photoconductor as set forth in claim 1, 2, or 3, wherein the moment of inertia I (g . $cm^2$) of said non-hollow conductive cylindrical support is in the range of $0.4 \leqq I \leqq 140$ (g . $cm^2$).

5. The photoconductor as set forth in claim 1, 2, or 3, wherein the diameter of said non-hollow conductive cylindrical support is in the range from 0.5 to 2.0 cm.

6. The photoconductor as set forth in claim 1, 2, or 3, wherein the relation $W_1/W_2 \leqq 7.8$ is satisfied, where $W_1$ is the weight of said non-hollow conductive cylindrical support and $W_2$ is the weight of a hollowed support which is made of the same material as said conductive cylindrical support, which has the same diameter and length as said conductive cylindrical support, and which has a thickness of 0.1 cm.

7. The photoconductor as set forth in claim 3, wherein the relation of 0.01 (cm)$\leqq D-d \leqq$2.0 (cm) is satisfied, where D (cm) is the diameter of a center portion of said non-hollow conductive cylindrical support and d (cm) is the diameter of said end portions.

8. The photoconductor as set forth in claim 3, wherein said drive transferring mechanism is a gear.

9. The photoconductor as set forth in claim 3, wherein said drive transferring mechanism is a groove for a pulley.

10. The photoconductor as set forth in claim 3, wherein said drive transferring mechanism is a D letter shaped end portion.

11. The photoconductor as set forth in claim 3, wherein said drive transferring mechanism is a concaved shape formed on at least one side of said end portions.

12. The photoconductor as set forth in claim 1, 2 or 3 wherein said non-hollow conductive cylindrical support is made of aluminum.

13. The photoconductor as set forth in claim 2 or 3, wherein said non-hollow conductive cylindrical support is made of stainless steel.

14. The photoconductor as set forth in claim 1, 2 or 3, wherein said non-hollow conductive cylindrical support is made of cast iron plated with a nickel group element.

15. The photoconductor as set forth in claim 3, wherein said non-hollow conductive cylindrical support is made of aluminum, the length of the photoconductive layer is $24.0 \times (1 \pm 0.1)$ cm, and the diameter of the conductive cylindrical support is $1.0 \times (1 \pm 0.1)$ cm, said conductive cylindrical support having an extruded drive transferring mechanism coaxially provided in a unified manner on both end portions of the conductive cylindrical support, the length and the diameter of said extruded drive transferring mechanism being $1.0 \times (1 \pm 0.1)$ cm and $0.5 \times (1 \pm 0.1)$ cm, respectively.

16. The photoconductor as set forth in claim 2, wherein the relation of 0.01 (cm)$\leqq D-d \leqq$2.0 (cm) is satisfied, where D (cm) is the diameter of a center portion of said non-hollow conductive cylindrical support and d (cm) is the diameter of said end portion.

17. A developing method of an electrophotography for developing an electrostatic latent image by using a toner, the method comprising the steps of:

forming a photoconductive layer on an outer periphery of a non-hollow conductive cylindrical support; and setting a relation of $$C/(S \cdot \omega) \leqq 0.4 \ (cal \cdot S/°C. \cdot cm^2 \cdot rad)$$

wherein S ($cm^2$) is the square measure of the portion of a photoconductive layer formed on said conductive cylindrical support; C (cal/°C.) is the heat capacity of said conductive cylindrical support; and $\omega$ (rad/S) is the rotating angular velocity at which the electrostatic latent image formed on said photoconductive layer is developed with the toner.

18. A developing method of an electrophotography for developing an electrostatic latent image by using a toner, the method comprising the steps of:

forming a photoconductive layer on an outer periphery of a non-hollow conductive cylindrical support; and setting the relation $r \cdot p \leqq 2.3$ (cm . cm/S), wherein r(cm) is the radius of curvature of said conductive cylindrical support and r is 0.75 cm or less; and p (cm/S) is the peripheral speed of the photoconductor at which the electrostatic latent image formed on said photoconductive layer is developed with the toner.

* * * * *

UNITED STATES PATENT AND TRADEMARK OFFICE

CERTIFICATE OF CORRECTION

PATENT NO. : 5,422,706

DATED : June 6, 1995

INVENTOR(S) : KOICHI TSUNEMI ET AL

It is certified that error appears in the above-indentified patent and that said Letters Patent is hereby corrected as shown below:

On the title page, item [57], in the Abstract, on line 9, change "$(g \cdot cm_2)$" to --$(g \cdot cm^2)$--.

In column 5, line 10, change "though" to --through--.

In column 6, line 26, change "an" to --a--.

In column 25, line 24, change "19000" to --1900--.

In column 26, line 52, after "Collection" insert closing quotes.

Signed and Sealed this

Sixth Day of August, 1996

Bruce Lehman

*Attest:*

BRUCE LEHMAN

*Attesting Officer*

*Commissioner of Patents and Trademarks*